US009922492B2

(12) United States Patent
Nakamura

(10) Patent No.: US 9,922,492 B2
(45) Date of Patent: Mar. 20, 2018

(54) GAMING MACHINE, CONTROL METHOD FOR MACHINE, AND PROGRAM FOR GAMING MACHINE

(71) Applicant: Konami Gaming, Inc., Las Vegas, NV (US)

(72) Inventor: Daisuke Nakamura, Las Vegas, NV (US)

(73) Assignee: KONAMI GAMING, INC., Las Vegas, NV (US)

( * ) Notice: Subject to any disclaimer, the term of this patent is extended or adjusted under 35 U.S.C. 154(b) by 12 days.

(21) Appl. No.: 15/005,882

(22) Filed: Jan. 25, 2016

(65) Prior Publication Data

US 2017/0213415 A1 Jul. 27, 2017

(51) Int. Cl.
*G07F 17/32* (2006.01)
*G07F 17/34* (2006.01)

(52) U.S. Cl.
CPC ..... *G07F 17/3213* (2013.01); *G07F 17/3225* (2013.01); *G07F 17/34* (2013.01)

(58) Field of Classification Search
USPC ..... 463/20
See application file for complete search history.

(56) References Cited

U.S. PATENT DOCUMENTS

| | | | | |
|---|---|---|---|---|
| 8,628,402 | B2 | 1/2014 | Nakamura | |
| 9,147,322 | B2 * | 9/2015 | Shiraishi | G07F 17/34 |
| 9,342,950 | B2 * | 5/2016 | Shiraishi | G07F 17/34 |
| 2013/0143638 | A1 | 6/2013 | Nakamura | |

FOREIGN PATENT DOCUMENTS

| | | | |
|---|---|---|---|
| JP | 2013-230264 | A2 | 11/2013 |
| JP | 2013-240450 | A | 12/2013 |

OTHER PUBLICATIONS

Notice of Reasons for Rejection (JP Patent Application No. 2017-003537); dated Jan. 30, 2018; Includes English Translation.

* cited by examiner

*Primary Examiner* — Pierre E Elisca
(74) *Attorney, Agent, or Firm* — Howard & Howard Attorneys PLLC

(57) ABSTRACT

A gaming machine that provides an operation unit, a display unit, and a control unit. The operation unit is configured to receive an operation of the player. The display unit is operably coupled to the operation unit and is configured to display a symbol display area. The symbol display area includes a plurality of cells arranged in a grid. The control unit is operably coupled to the operation unit and the display unit and being configured to initiate a game in response to player operation and to establish an outcome of the game. During the game, the control unit, in response to a trigger condition, is further configured to establish a set of replacement symbols and to divide the set of replacements symbols into two groups and to display the replacement groups using features or feature animations.

43 Claims, 32 Drawing Sheets

78

78

72

78

72

74

78

| | | | | |
|---|---|---|---|---|
| 1 (40%) | 4 (60%) | 7 (65%) | 10 (55%) | 13 (50%) |
| 2 (40%) | 5 (60%) | 8 (65%) | 11 (55%) | 14 (50%) |
| 3 (40%) | 6 (60%) | 9 (65%) | 12 (55%) | 15 (50%) |

60

FIG. 8A

| | | | | |
|---|---|---|---|---|
| W | W | | | |
| W | | W | W | |
| W | | W | | W |

FIG. 19A

| | | | | |
|---|---|---|---|---|
| | W | | | |
| | | W | W | |
| | | W | | W |

FIG. 19C

| | | | | |
|---|---|---|---|---|
| W | | | | |
| W | | | | |
| W | | | | |

FIG. 19D

| manner # | Group 1 | Group 2 |
|---|---|---|
| 1 | reel 2,3,4,5 | reel 1 |
| 2 | reel 1,3,4,5 | reel 2 |
| 3 | reel 1,2,4,5 | reel 3 |
| 4 | reel 1,2,3,5 | reel 4 |
| 5 | reel 1,2,3,4 | reel 5 |
| 6 | reel 3,4,5 | reel 1,2 |
| 7 | reel 2,4,5 | reel 1,3 |
| 8 | reel 2,3,5 | reel 1,4 |
| 9 | reel 2,3,4 | reel 1,5 |
| 10 | reel 1,4,5 | reel 2,3 |
| 11 | reel 1,3,5 | reel 2,4 |
| 12 | reel 1,3,4 | reel 2,5 |
| 13 | reel 1,2,5 | reel 3,4 |
| 14 | reel 1,2,4 | reel 3,5 |
| 15 | reel 1,2,3 | reel 4,5 |

FIG. 19B

GAMING MACHINE, CONTROL METHOD FOR MACHINE, AND PROGRAM FOR GAMING MACHINE

TECHNICAL FIELD

The present invention relates to a gaming machine, a control method for a gaming machine, and a program for a gaming machine.

BACKGROUND ART

A gaming machine represented by a slot machine is highly popular among casino customers as a device that provides gaming that is easy to enjoy, and recent statistics report that sales from gaming machines account for the majority of casino earnings. Initial slot machines were simple devices, wherein an inserted coin is received, a configured reel rotates and stops mechanically according to a handle operation, and a win or a loss is determined by a combination of symbols stopped on a single pay line. However, recent gaming machines, such as mechanical slot machines driven by a highly accurate physical reel via a computer controlled stepping motor, video slot machines that display a virtual reel on a display connected to a computer, and various gaming machines that apply similar technology to other casino games are quickly advancing. For the manufacturers that develop these gaming machines, an important theme is to provide an attractive game that strongly attracts casino customers as players, and improves the functionality of the gaming machine.

SUMMARY OF INVENTION

In one aspect of the present invention, a gaming machine is provided. The gaming machine includes an operation unit, a display unit, and a control unit. The operation unit is configured to receive an operation of the player. The display unit is operably coupled to the operation unit and is configured to display a symbol display area. The symbol display area includes a plurality of cells arranged in a grid. The control unit is operably coupled to the operation unit and the display unit and being configured to initiate a game in response to player operation and to establish an outcome of the game. The control unit, in response to initiation of the game, is further configured to:

randomly establish a first set of symbols associated with the symbol display area, each symbol in the first set of symbols being associated with one of the plurality of cells in the group;

randomly establish a set of replacement symbols, each symbol in the set of replacement symbols being associated with one of the plurality of cells in the group and adapted to replace the symbol from the first set of symbols associated with the respective cell in the grid;

divide the set of replacement symbols into a first group of replacement symbols and a second group of replacement symbols;

display the replacement symbols in the first group of replacement symbols and the symbols in the second group of replacement symbols in the respective associated cells of the grid, the first group of replacement symbols, the second group of replacement symbols and any remaining symbols in the first set of symbols forming the outcome, wherein the control unit, in displaying the replacement symbols, is further configured to: display the replacement symbols in the first group of replacement symbols using a first feature and to display the symbols in the second group of replacement symbols in the respective associated cells of the grid using a second feature; and, award a payout to the player as a function of the outcome.

In another aspect of the invention, a control method for a gaming machine provides a game to a player. The gaming machine includes an operation unit, a display unit, and a control unit. The operation unit is configured to receive an operation of the player. The display unit is operably coupled to the operation unit and is configured to display a symbol display area. The symbol display area includes a plurality of cells arranged in a grid. The control unit is operably coupled to the operation unit and the display unit and is configured to initiate a game in response to player operation and to establish an outcome of the game. The method including the steps of:

randomly establishing, by the control unit, a first set of symbols associated with the symbol display area, each symbol in the first set of symbols being associated with one of the plurality of cells in the group;

randomly establishing, by the control unit, a set of replacement symbols, each symbol in the set of replacement symbols being associated with one of the plurality of cells in the group and adapted to replace the symbol from the first set of symbols associated with the respective cell in the grid;

dividing, by the control unit, the set of replacement symbols into a first group of replacement symbols and a second group of replacement symbols;

displaying, in the display area of the display unit, the replacement symbols in the first group of replacement symbols and the symbols in the second group of replacement symbols in the respective associated cells of the grid, the first group of replacement symbols, the second group of replacement symbols and any remaining symbols in the first set of symbols forming the outcome, wherein the control unit, in displaying the replacement symbols, displays the replacement symbols in the first group of replacement symbols using a first feature and displays the symbols in the second group of replacement symbols in the respective associated cells of the grid using a second feature; and, awarding, by the control unit, a payout to the player as a function of the outcome.

In still another aspect of the present invention, a program for a gaming machine provides a game to a player. The gaming machine includes an operation unit, a display unit, and a control unit. The operation unit is configured to receive an operation of the player. The display unit is operably coupled to the operation unit and is configured to display a symbol display area. The symbol display area includes a plurality of cells arranged in a grid. The control unit is operably coupled to the operation unit and the display unit and is configured to initiate a game in response to player operation and to establish an outcome of the game. The program of the gaming machine performing the steps of:

randomly establishing, by the control unit, a first set of symbols associated with the symbol display area, each symbol in the first set of symbols being associated with one of the plurality of cells in the group;

randomly establishing, by the control unit, a set of replacement symbols, each symbol in the set of replacement symbols being associated with one of the plurality of cells in the group and adapted to replace the symbol from the first set of symbols associated with the respective cell in the grid;

dividing, by the control unit, the set of replacement symbols into a first group of replacement symbols and a second group of replacement symbols;

displaying, in the display area of the display unit, the replacement symbols in the first group of replacement symbols and the symbols in the second group of replacement symbols in the respective associated cells of the grid, the first group of replacement symbols, the second group of replacement symbols and any remaining symbols in the first set of symbols forming the outcome, wherein the control unit, in displaying the replacement symbols, displays the replacement symbols in the first group of replacement symbols using a first feature and displays the symbols in the second group of replacement symbols in the respective associated cells of the grid using a second feature; and, awarding, by the control unit, a payout to the player as a function of the outcome.

BRIEF DESCRIPTION OF DRAWINGS

FIG. 8A is a chart illustrating probabilities associated with the display area, according to an embodiment of the present invention.

FIG. 19A is an exemplary set of extra wilds to be added to the grid, according to an embodiment of the present invention.

FIG. 19B is an exemplary set of reel groupings, according to an embodiment of the present invention.

FIGS. 19C-19D are diagrammatic illustrations of the first and second groups of extra wilds, according to an embodiment of the present invention.

DETAILED DESCRIPTION OF EMBODIMENTS

A gaming machine, according to an embodiment of the present invention, referencing the attached figures is described in detail below. Further, duplicated descriptions will be omitted for identical attached symbols in identical or corresponding parts in each figure.

With reference to the drawings, and in operation, the present invention is directed towards a gaming machine, a control method for a gaming machine, and a program for a gaming machine that provides a game to a player. In one embodiment, the game includes a primary game and a feature game. As will be discussed in further detail below, the feature game may add add/replacement symbols to a display area utilizing a first feature and a second feature, or a unified feature.

Figure 1A:
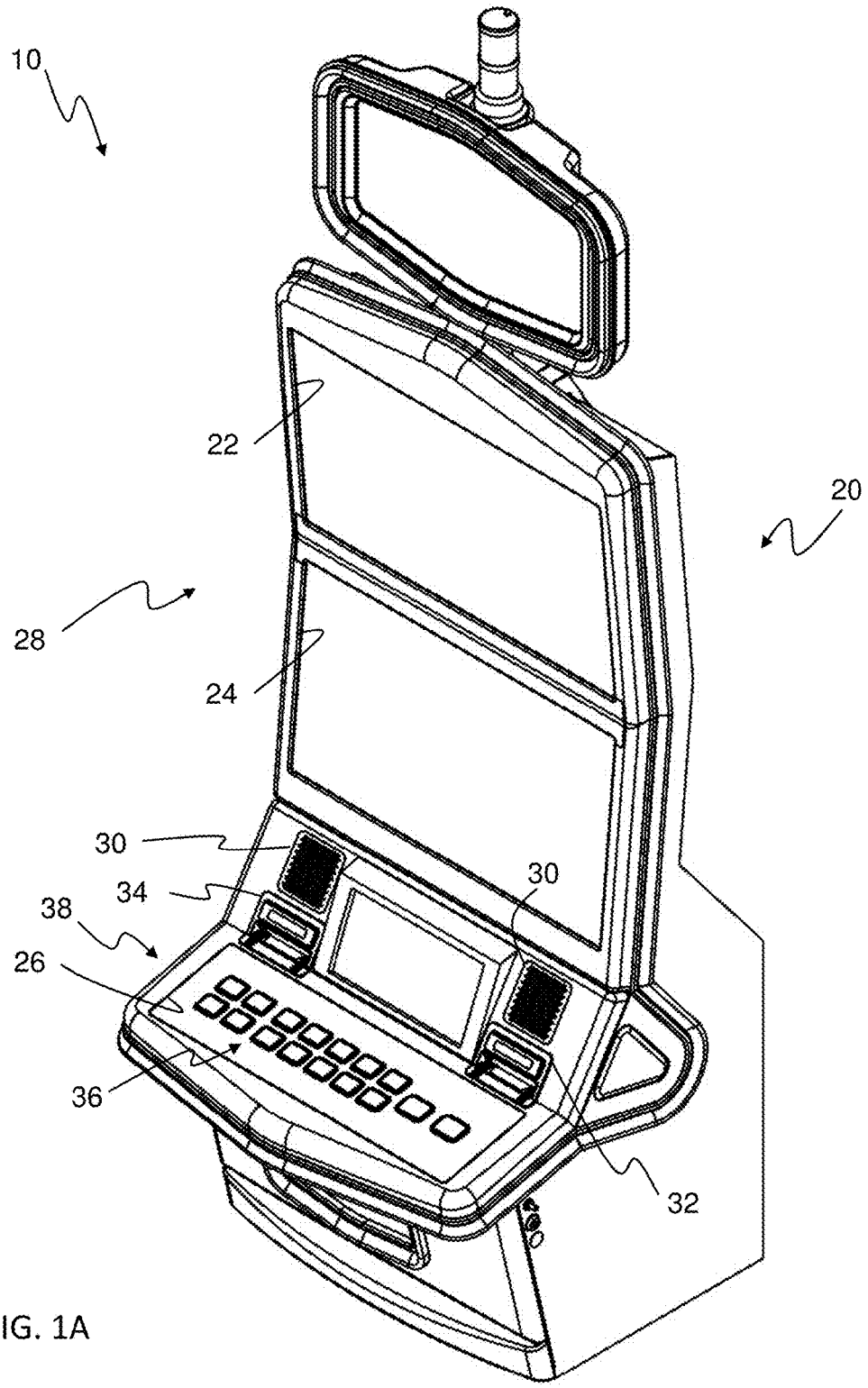
FIG. 1A is a perspective view of the gaming machine, according to the first embodiment.
Figure 1B:
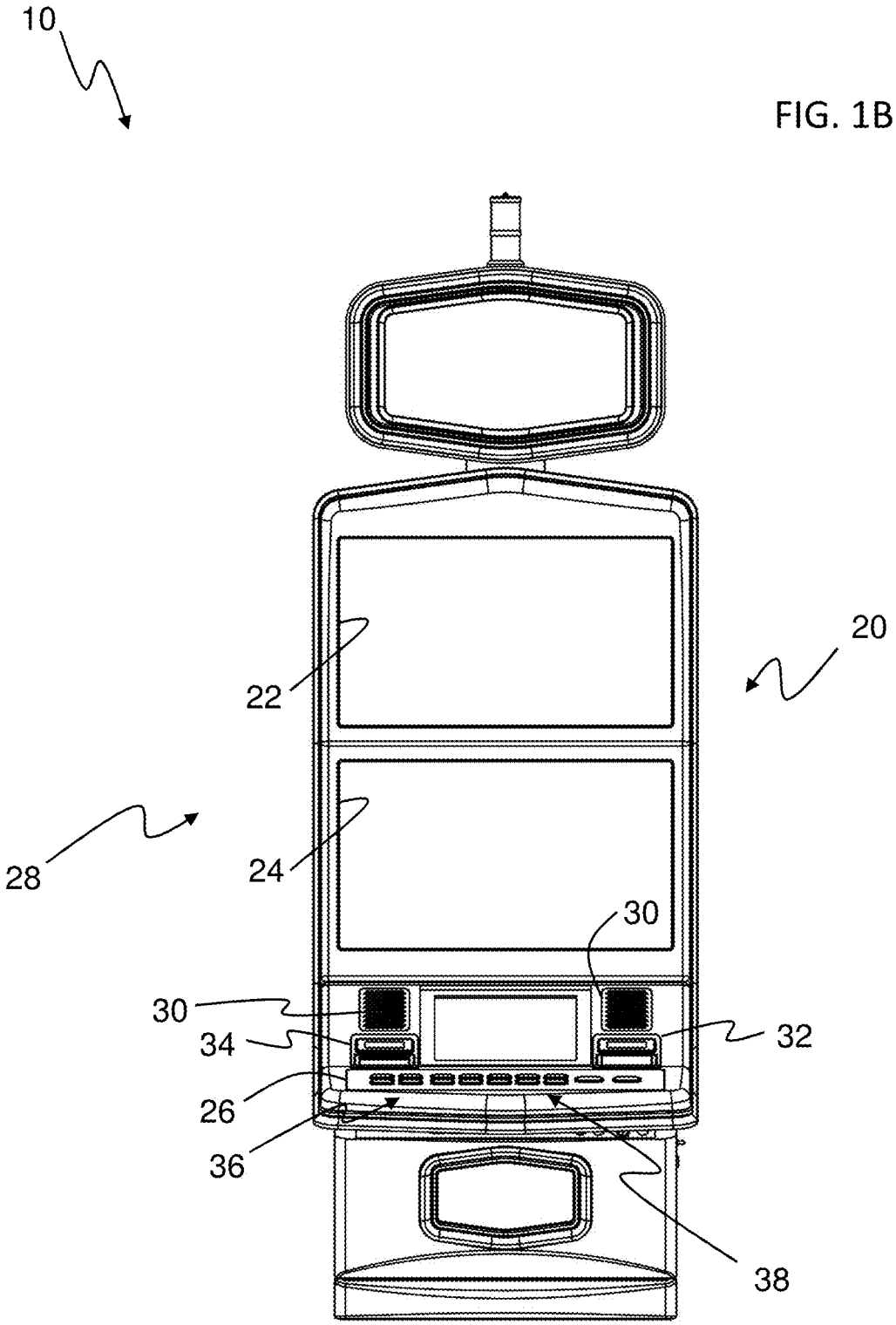
FIG. 1B is a front view of the gaming machine of FIG. 1A.

The gaming machine according to the present embodiment, receives a predetermined game value from the player, generates a game result, and provides a payout to the player according to the game result. FIG. 1A and FIG. 1B are a perspective view and a front view, respectively, of a gaming machine 10, according to the present embodiment. As shown in FIG. 1, this gaming machine 1 provides a cabinet 20 providing an upper display 22, a lower display 24, a control panel 26 and may also house a player tracking or ranking unit 57 (see FIG. 2). The cabinet 20 also houses a control unit 50 (see FIG. 2) that controls each part (see below). The control unit 50 also implements a random number generator (RNG) that is used during operation of the game. Each configuration is described below.

The upper display 22 and the lower display 24 may be flat panel display devices, such as both liquid crystal display devices and organic EL display devices and the like, and by controlling via each control unit 50, the game screen mentioned below functions as a display unit 28 provided to the player.

Speakers 30 are provided on the left and right of the cabinet 20, and by controlling via the control unit 50, sound is provided to the player. On the control panel 26, a bill/ticket identification unit 32, the printer unit 34, and an operation unit 36 are provided.

The player tracking unit may be housed on the center of the front surface of the third cabinet 20. The player tracking unit has a card reader that recognizes a player identification card, a display that presents data to the player, and a keypad that receives input by the player. This type of player tracking unit reads information recorded on the player identification card inserted by the player into the card reader, and displays the information and/or information acquired by communicating with the external system on the display, by cooperatively operating with the control unit 50 mentioned below or an external system. Further, input from the player is received by the keypad, the display of the display is changed according to the input, and communication with the external system is carried out as necessary.

The bill/ticket identification unit 32 is disposed on the control panel 26 in a state where the insertion opening that a bill or ticket is inserted into is exposed, an identification part that identifies a bill/ticket by various sensors on the inside of the insertion opening is provided, and a bill/ticket storage part is provided on the outgoing side of the identification part. The bill/ticket identification unit 32, receives and identifies bills and tickets (including vouchers and coupons) that are the game value as a game executing value, and notifies the control unit 50 mentioned below.

The printer unit 34 is disposed on the control panel 26 in a state where the ticket output opening that a ticket is output from is exposed, a printing part that prints predetermined information on a printing paper on the inside of the ticket output opening is provided, and a housing part that houses the printing paper inside the paper inlet side of the printing part is provided. The printer unit 34, under the control of the control unit 50 mentioned below, prints information on paper and outputs a ticket according to credit payout processing from the gaming machine 10. The output ticket can use the payout credit as game play by being inserted into the bill/ticket identification unit of another gaming machine, or, can be exchanged for cash by a kiosk terminal inside of the casino or a casino cage.

The operation unit 36 receives the operation of the player. The operation unit 36 includes a group of buttons 38 that receives various instructions from the player on the gaming machine 10. The operation unit 36, for example, may include a spin button and a group of setting buttons. The spin button receives an instruction to start (start rotating the reel) the game listed below. The group of setting buttons 38 includes a group of bet buttons, a group of line-designation buttons, a max bet button, and a payout button and the like. The group of bet buttons receives an instruction operation regarding the bet amount of credits (bet number) from the player. The group of line-designation buttons receive an instruction operation that designate a pay line (referred to as an effective line below) subjected to a line judgment below from the player. The max bet button receives an instruction operation regarding the bet of the maximum amount of credits that can be bet at one time from the player. The payout button receives an instruction operation instructing a credit payout accumulated in the gaming machine 10.

Figure 2:
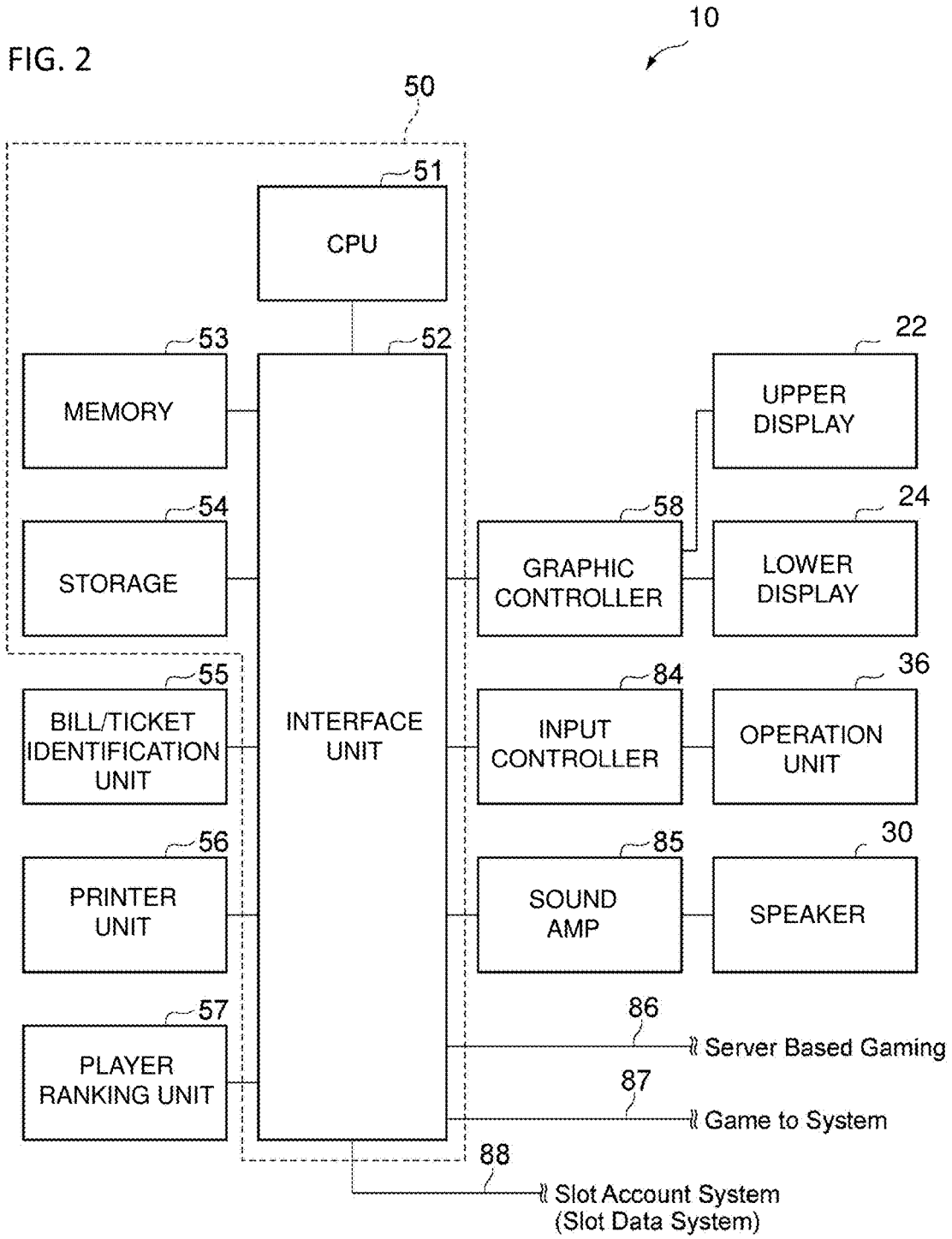
FIG. 2 is a functional block diagram of the gaming machine in FIG. 1.

With reference to FIG. 2, further on the inside of the cabinet 20, a control board equipped with a central processing unit 51 (abbreviated as CPU below) that configures the control unit 50, an interface unit (or part) 52, a memory 53 and a storage 54 and the like are incorporated. The control board is configured so that communication is possible through the interface unit 52 and each of the components equipped on the cabinet 20, controls the operation of each part by executing the program recorded in the memory 53 or the storage 54 of the CPU 51, and provides a game to the player.

FIG. 2 shows a functional block diagram of the gaming machine 10, according to the present embodiment. The gaming machine 10 provides the control unit 50. The control unit 50 is configured as the interface unit 52 including a chip set providing communication functions of the CPU 51, a memory bus connected to a CPU, various expanding buses, serial interfaces, USB interfaces, Ethernet (registered trademark) interfaces and the like, and a computer unit where the CPU 51 provides the addressable memory 53 and the storage 54 through the interface unit 52. The memory 53 can be configured to include RAM that is a volatile storage medium, ROM that is a nonvolatile storage medium, and EEPROM that is a rewritable nonvolatile storage medium. The storage 54 provides the control unit 50 as an external storage device function, can use reading devices such as a memory card that is a removable storage medium, and a magneto optical disk and the like, and can use hard disks.

On the interface unit 52, in addition to the CPU 51, the memory 53, and the storage 54, a bill/ticket identification unit 55, a printer unit 56, the player tracking unit 57, a graphic controller 58, an input controller 84, and a sound amp 85 are connected. That is, the control unit 50 is connected to the operation unit 36 through the input controller 84, and connected to the upper display 22 and/or the lower display 24 through the graphic controller 58. Further, when illumination that provides decorative lighting to the gaming machine 10 is provided, the illumination is controlled under the control of the control unit 50 on the interface unit 52, and an illumination controller that provides a decorative lighting effect may be connected.

The control unit 50, which includes memory 53 and storage 54, controls each part by executing a program stored in the memory 53 and the storage 54, and provides a game to the player. Here, for example, the memory 53 and storage 54 may be configured to store a program and data of an operating system and subsystem that provide the basic functions of the control unit 50 to the EEPROM of the memory 53, and stores a program and data of an application that provides a game to the storage 54. According to such a configuration, it can be easy to change or update a game by replacing the storage 54. Further, the control unit 50 may be a multiprocessor configuration that has a plurality of CPUs.

Each block connected to the control unit 50 is described below. The bill/ticket identification unit 55 corresponds to the bill/ticket identification unit 32, receives bills or tickets in the insertion opening, and notifies the control unit 50 of identifying information corresponding to the assortment of bills or the payout processing of credits. The bill/ticket identification unit 55 notifies the information to the control unit 50, and the control unit 50 increases the usable credit amount inside of the game according to the notified content. The printer unit 56 corresponds to the printer unit 34, and under the control of the control unit 50 that receives an operation of the payout button of the group of setting buttons 38, information corresponding to the credit payout processing from the gaming machine 10 is printed and output on a printed ticket.

The player ranking (or tracking unit) unit 57 cooperatively operates with the control unit 50, and sends and receives information and the like of the player from the casino management system. The graphic controller 58 controls the upper display 22 and the lower display 24, under the control of the control unit 50, and displays a display image that includes various graphic data. The sound amp 85 drives the speakers 30 under the control of the control unit 50, and provides various sounds such as an announcement, sound effects, BGM and the like.

Further, the interface unit 52, has various communication interfaces for communicating with the exterior of the gaming machine 10, for example the interface unit 52 can communicate with an external network by Ethernet 86, 87, and a serial output 88. In the present embodiment, one example shows when there is communication between a well-known server side gaming network (Server Based Gaming of FIG. 2), a G2S network (Game to System of FIG. 2), and a slot information system (Slot Data System of FIG. 2), respectively.

Figure 3A:
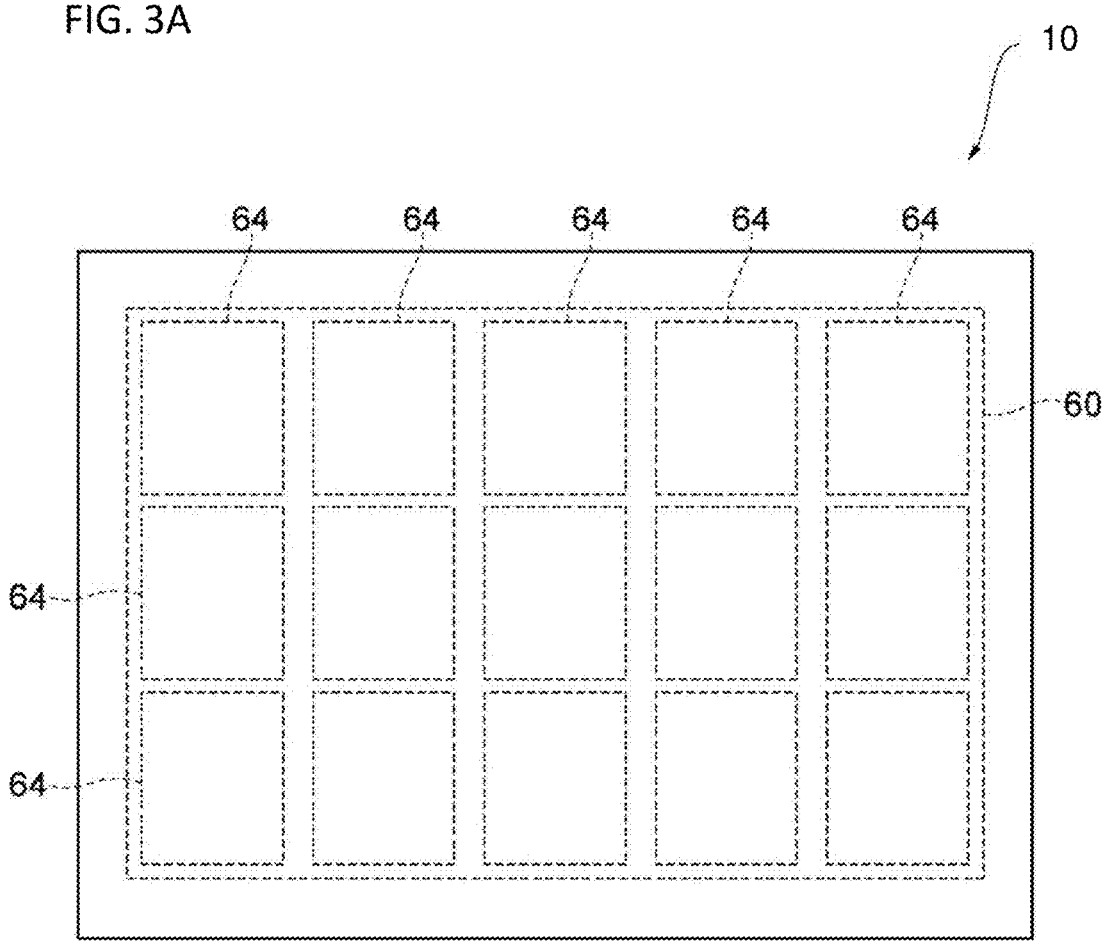
FIG. 3A is a first diagrammatic illustration of a primary display area of the gaming machine in FIG. 1, according to an embodiment of the present invention.

FIG. 3A is a figure schematically showing a game screen provided by the gaming machine 10, according to the present embodiment. Such a game screen is displayed on the display unit 28 (the upper display 22 and/or the lower display 24) by the control unit 50 executing a predetermined program. In the illustrated embodiment, the game screen is displayed on the lower display 24.

In one aspect of the present invention, the gaming machine 10 provides a game to the player. The game may include a primary game and a bonus game. For instance, the primary game may be a video slot game, and the bonus game may be the awarding of a number of free games or spins in response to the occurrence of a trigger condition, e.g., during the primary game. During either the primary game or the bonus game, in response to a predetermined trigger, a number of extra or replacement symbols may be awarded to the player. The replacement symbols may replace the symbols in the outcome of the (primary or bonus) game. In one embodiment, the replacement symbols are established and divided into a first group of replacement symbols and a second group of replacement symbols. As described below, the first and second groups of replacement symbols are displayed using a first feature and a second feature, respectively. Alternatively, under certain predetermined conditions, the replacement symbols are displayed using a unified feature (see below).

The replacement symbols may be established and used in the primary game, or during the bonus game.

The game of the present invention utilizes a determination or display area or grid 60 during the game. The present embodiment shows the state of displaying the game screen on the lower display 24. As shown in FIG. 3A, this game screen has a determination area 60 for displaying symbols. By using such a game screen, the gaming machine 10 of the present embodiment operates as a slot machine that pays a payout according to a winning combination of symbols displayed on the determination area 60.

The display unit 28 displays a plurality of symbols in the display area 60. The determination area, or grid, 60 has a plurality of rows (r) and columns (c). The determination area 60 is configured by a plurality of cells 64 that are the stop position of symbols. Specifically, the display area 60 may be configured by 15 cells disposed in a grid shape of 3 rows and 5 columns.

Figure 3B:
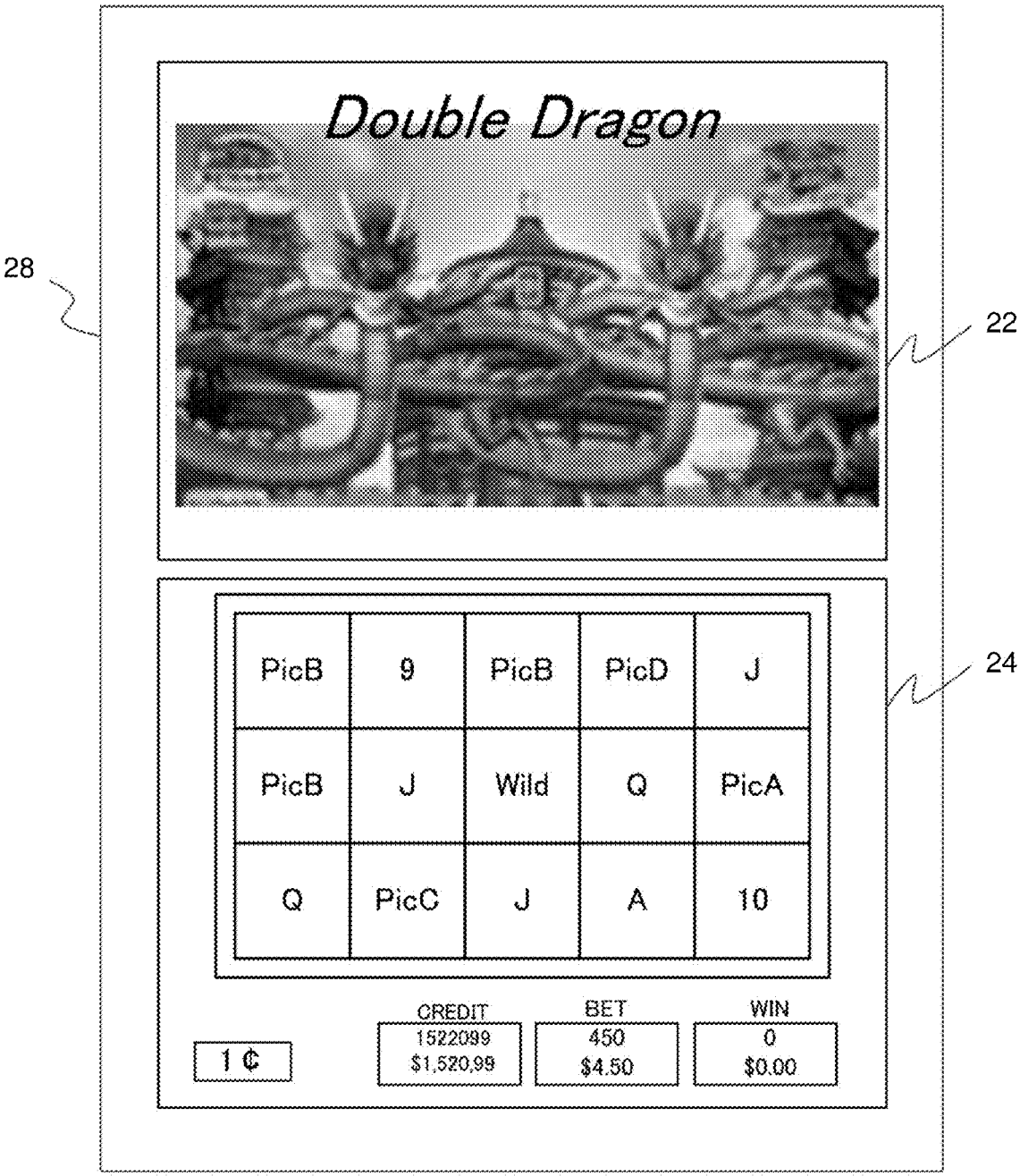
FIG. 3B is a diagrammatic illustration of the primary display area and a bonus display area of the gaming machine in FIG. 1, according to an embodiment of the present invention.

With reference to FIG. 3B, the determination area or grid 60 is displayed on the lower display 24. The upper display 22 may be used to display animations during the feature animations. Further, the display unit 28 can display a decorative area, and an area that displays credit amount, bet number, and a credit amount obtained by winning (WIN number) and the like, outside of the determination area 60. On each of the plurality of cells 64 of the display area 60, one symbol is stopped and displayed.

Figure 4:
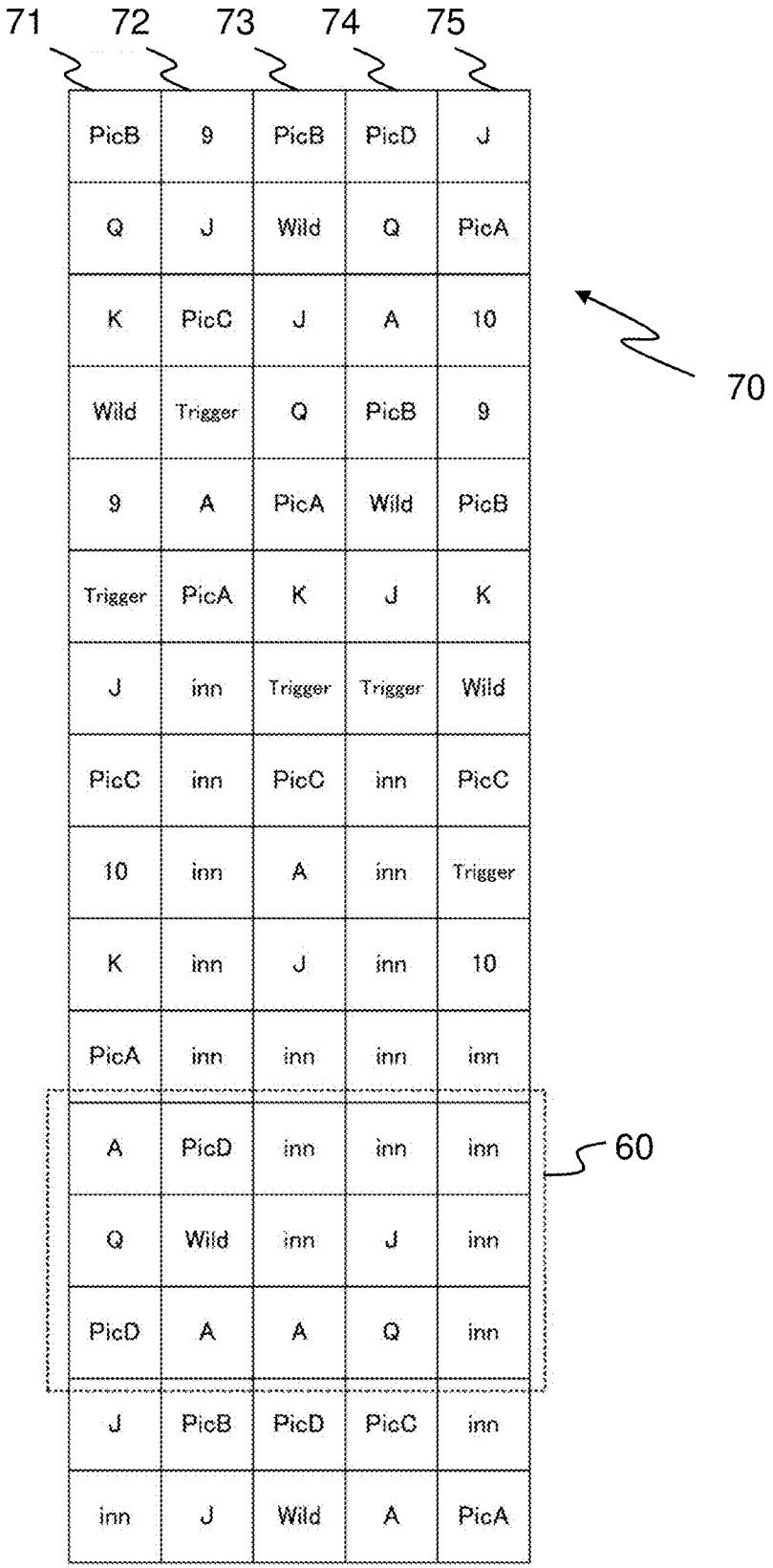
FIG. 4 is a figure showing one example of a symbol arrangement showing the order of symbols displayed on the display area in FIG. 3A.

On each cell 64 of the display area 60, as shown in FIG. 4, a symbol is displayed based on the symbol arrangement of virtual reel strips 71 to 75 configured of a virtual reel set 70. That is, the cells 64 of the display area 60 correspond to the virtual reel strips 71 to 75 by column, and the symbols disposed on predetermined parts of each virtual reel strip 71 to 75 are displayed. Furthermore, as mentioned below, by moving (scrolling or spinning) each symbol by column based on the symbol arrangement of the virtual reel strips 71 to 75, the symbols displayed in the cells 64 of the determination area 60 change, and by stopping the movement (scrolling or spinning) by columns, the symbols are stopped. Here, the virtual reel strips 71 to 75 are data where the control unit 50 uses a program having the memory 53 or the storage 54, and data showing the symbol arrangement (i.e., the order of symbols on each reel) regulated by each cell column. Further, the virtual reel set 70 is a general term for such virtual reel strips 71 to 75.

Figure 5:
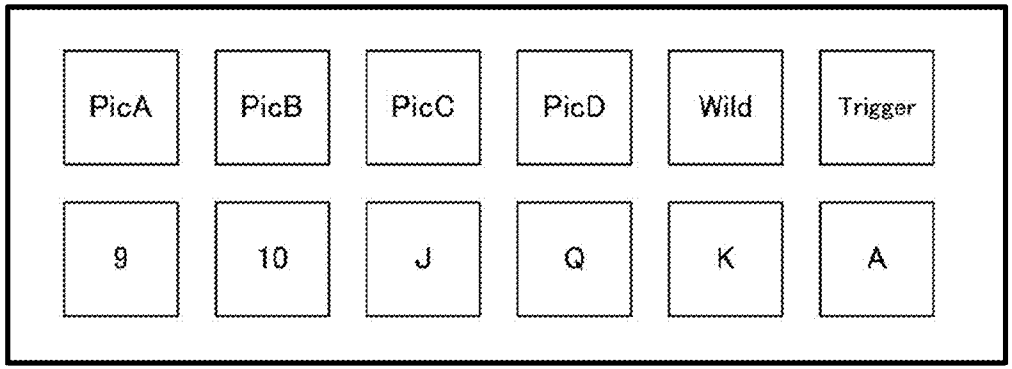
FIG. 5 is a figure showing the symbols displayed on the determination area in FIG. 3.

Each virtual reel strip 71 to 75, in an example of FIG. 4, is configured by 19 symbols, and those symbols are aligned in an order defined by each reel. FIG. 5 is the details of symbols of the figure shown in FIG. 4. Each virtual reel strip 71 to 75 includes symbols selected from a symbol set of 13 varieties shown in FIG. 5. This symbol set includes card symbols ("9", "10", "J", "Q", "K", and "A") that imitate playing cards as regular symbols, and picture symbols ("PIC-a", "PIC-b", "PIC-c", and "PIC-d") that show a pattern. Further, this symbol set includes a wild symbol ("Wild") that is substituted as another symbol when a win is determined and a trigger or symbol ("Trig") that is used to determine if a bonus game is to be played (see below). Each of these symbols have a different rank from each other regarding their value when winning, their rank gradually raises in this order: "9", "10", "J", "Q", "K", "A", "PIC-d", "PIC-c", "PIC-b", "PIC-a". A combination of symbols that includes high-ranking symbols when winning, can obtain a larger winning payout compared to a combination of low-ranking symbols when winning. Further, each virtual reel strip 71 to 75 may include one or more variable symbols ("inn") that is transformed into one of the other symbols (see FIG. 5) for each game or spin.

The control unit 50 starts a game, determines the stop position of each virtual reel strip 71 to 75 randomly, the virtual reel strips 71 to 75 move from a current position, and the operation to stop on a stop position uses the display unit 28 (for example, the lower display 24) and is expressed. Due to this, in the display or determination area 60, the symbols included on the virtual reel strips 71 to 75 are continuously moved (scrolled or spun) in the vertical direction of the display area 60, and one symbol of one cell 64 aligned in an order of the symbol based on the symbol arrangement is stopped so that it is displayed.

The control unit 50 changes and stops the plurality of symbols displayed on the display unit 28 according to the operation of the player received by the operation unit 36, and a payout may be paid according to the stopped symbols inside the determination area 60.

In the display area 60, a pay line is set that is used when winning is determined. The pay line is set to be extended over the column on the right end from the cells of the column of the left end, and is a line that combines the plurality of cells 64 determining a win. The number of effective lines within the set pay line is selected by the operation of a group of line designation buttons included in the group of setting buttons 38 of the operation unit 36 for the player. The control unit 50, in regards to the result of a game that is a combination of symbols, determines a win when a predetermined number of identical symbols is surpassed and aligned on a set pay line, and pays a payout to the player according to the type and number of symbols. On the gaming machine 10 of the present embodiment, a predetermined number of pay lines (LINE 1-40) of cells with three rows and five columns in the display area 60 is set (see FIG. 6). The system for determining a win may determine a win when a predetermined number of identical symbols from cells of the column on the left end are aligned on a set pay line, may determine a win when a predetermined number of identical symbols from cells of the column on the right end are aligned on a set pay line, and may determine a win when a predetermined number of identical symbols are aligned on a continuous column on a predetermined pay line.

Figure 6:
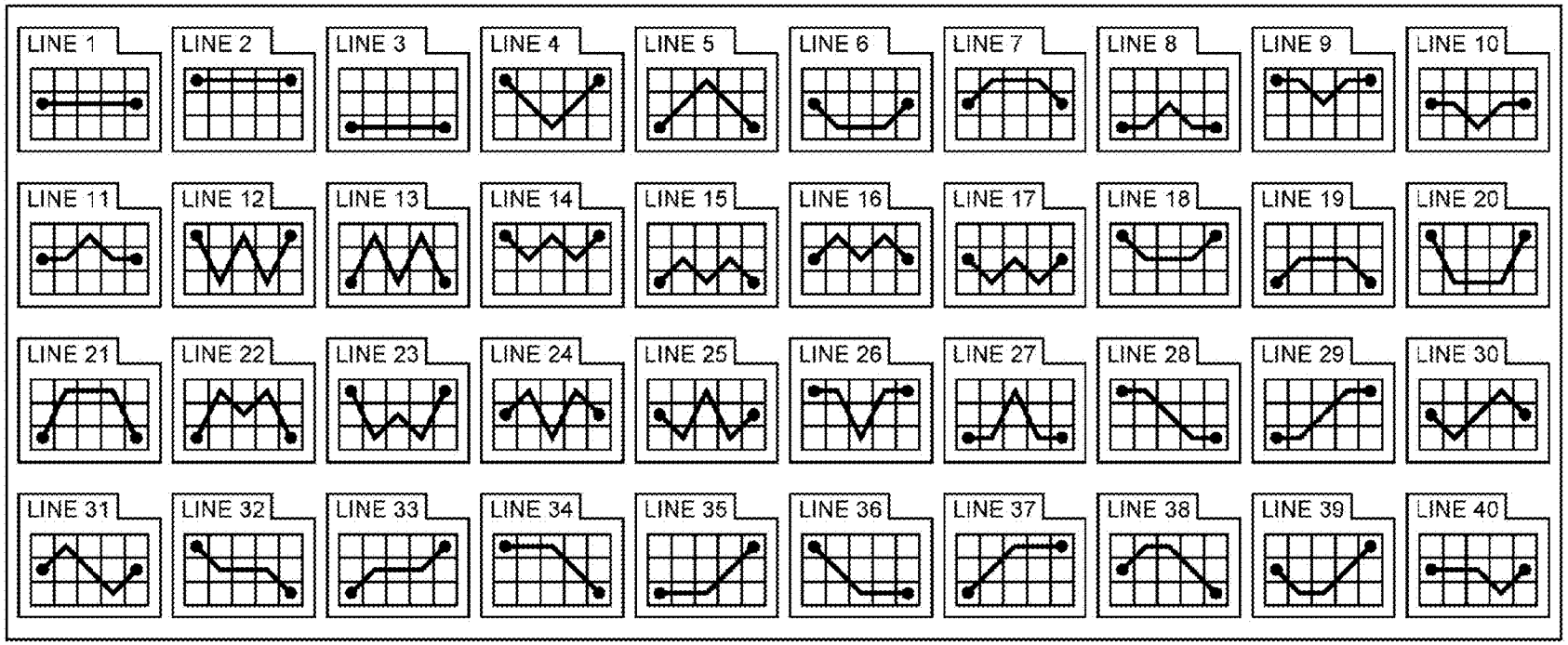
FIG. 6 is a figure showing one example of a pay line set on the determination area in FIG. 3.

It should be noted that pay lines shown other than (or in addition to) the pay lines shown in FIG. 6 may be used. In general, the pay lines shown in FIG. 6 start in the first column and end in the last column, and include one cell per column. However, one or more pay lines could include one or more cells in the same column and may include a vertical pay line.

The gaming machine 10 of the present embodiment may provide two types of games, a primary game (also referred to as a main game) and a special game (referred to as a bonus game which includes providing one or more free games or spins that do not consume game value) provided when predetermined conditions are satisfied. Concerning a primary game and a free game, the symbols displayed in the display area 60 configure a combination of symbols that are the result of a game, and determine a win.

In one aspect of the present invention, a multi-step extra symbol feature may be provided. The multi-step extra symbol feature may be provided during a main or primary game, or a special game. During the game in which the multi-step extra symbol feature is provided, the multi-step extra symbol feature is triggered based on a predetermined trigger condition. The predetermined trigger condition may be a mystery trigger, or may be based on an outcome or interim/preliminary outcome of the game.

In one embodiment, the multi-step feature may be triggered by a single random number associated with a combination, i.e., both, of the first group of replacement symbols and the second group of replacement symbols. In another embodiment, the multi-step feature may be triggered by a combination of random numbers associated with each group of replacement symbols. In these cases, the combination of the first and the second groups of replacement symbols may be determined beforehand by simulating the methods described below. Further, it is possible to randomly determine whether to provide the multi-step feature or unified feature.

As will be discussed in more depth below, after the multi-step extra symbol feature is triggered, a plurality of extra symbols is established. The extra symbols are added to the grid 60 using one or more feature animations ("features"). The extra symbols replace the symbols in the outcome of the game resulting from the spinning of the virtual reels 71 to 75. The replacement, as will be discussed more fully below, may occur before the reels 71 to 75 start spinning, while the reels 71 to 75 are spinning, and/or after the reels 71 to 75 stop spinning.

In one embodiment, the extra symbol is selected from the set or a subset of the available symbols (see FIG. 5). In another embodiment, the extra symbol is a Wild symbol.

In one aspect of the invention, the replacement symbols are added to the grid using a feature animation of a variable reel strip that moves the variable reel strip over the grid 60 in a selected pattern. In one embodiment, the variable reel strip takes the form of a dragon that is initially displayed in the upper display 22. The variable reel strip leaves the upper display 22 and enters the lower display 24 at one of the sides of the lower display 24. The variable reel strip traverses the grid and moves over each cell 64 in the grid 60, depositing an extra symbol or Wild symbol in one or more of the cells 64. Such a variable reel strip, known as a "Dragon Reel", is disclosed in U.S. Pat. No. 8,628,402, issued on Jan. 14, 2014, which is incorporated by reference.

It should be noted that the present invention is not limited to any specific length of virtual reels, symbols, ranking of symbols and/or pay lines.

With particular reference to FIGS. 3A, 3B, and 7A-7H, a first embodiment of the present invention will be discussed. As mentioned above, the present invention may provide a main game and a bonus game. The main game or the bonus game may be a video slot game, and may be played on a primary determination area or grid 60. As shown in FIG. 3A, in the first embodiment, a 3×5 grid of cells 64 may be used. In one embodiment, the game may be played or provided by the control unit 50 until a trigger condition has been met. For instance, in one embodiment, the trigger condition may be defined as the appearance of a predetermined number of trigger symbols ("Trig") in an outcome of the game. It should be noted that the trigger condition may be any suitable condition or set of conditions that may occur in the game, or occur independent of the game, e.g., from an outside source such as a player tracking system. The trigger condition may be a mystery trigger event, i.e., an event which while related to the main game, is not visible or part of or shown within the outcome of the game. Once the trigger condition has been met, a multi-step feature may be provided.

The operation unit 36 is configured to receive an operation of a player. The display unit 28 is configured to display the symbol display area or grid 60. As discussed above, the symbol display area or grid 60 includes a plurality of cells 64. The control unit 50 is operably coupled to the operation unit 36 and the display unit 28, and is configured to initiate a game in response to player operation and to establish an outcome of the game. In response to the game being initiated, the control unit 50 randomly establishes, using the RNG, a first set of symbols associated with the symbol display area 60. Each symbol in the first set of symbols is associated with one of the plurality of cells in the group.

Figure 7A:
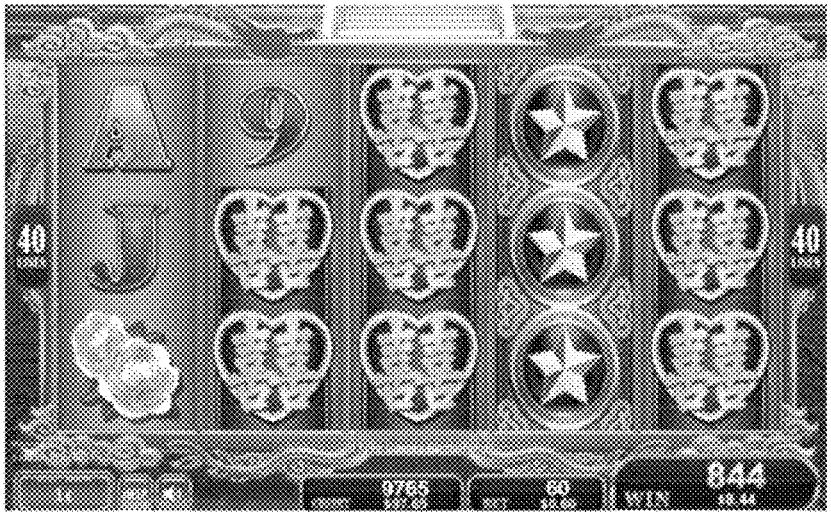
FIGS. 7A-7H are diagrammatic illustrations of the feature display area of the gaming machine in FIG. 1 during a game, according to an embodiment of the present invention.

As shown in the exemplary screenshot 78 of FIG. 7A, the first set of symbols form an initial outcome. In the illustrated embodiment, the game is a video slot game and the columns of the grid 60 represent reels in the video slot game. The video slot game presents an animation that simulates rotation of the reel strips 71 to 75 in the respective column. In the illustrated embodiment, the initial outcome is displayed before any replacement symbols are displayed. However, as discussed in more detail below, the feature animations used to display the extra symbols may be played before the reels stop spinning, while the reels are spinning and/or after the reels have stopped. The replacement symbols, along with any remaining, i.e., non-replaced symbols from the first set of symbols, form the outcome or final outcome of the game. An award or payout may be awarded to the player based on the final outcome of the game.

Figure 7B:
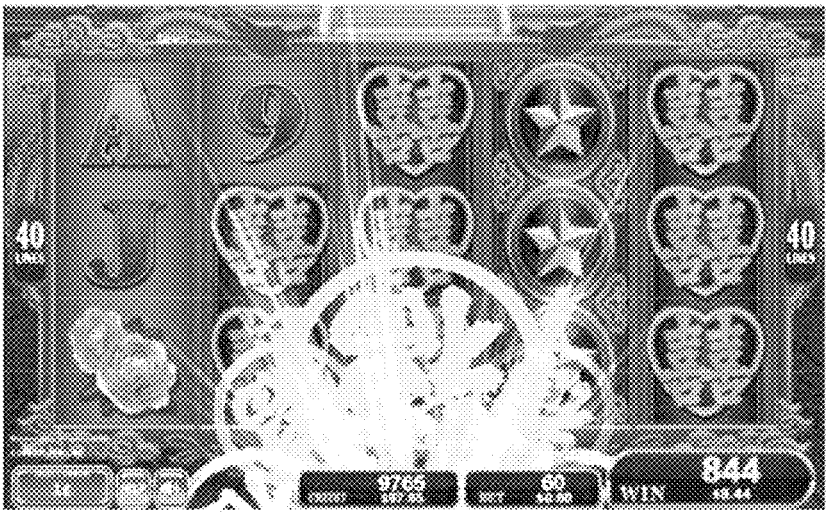
Figure 7C:
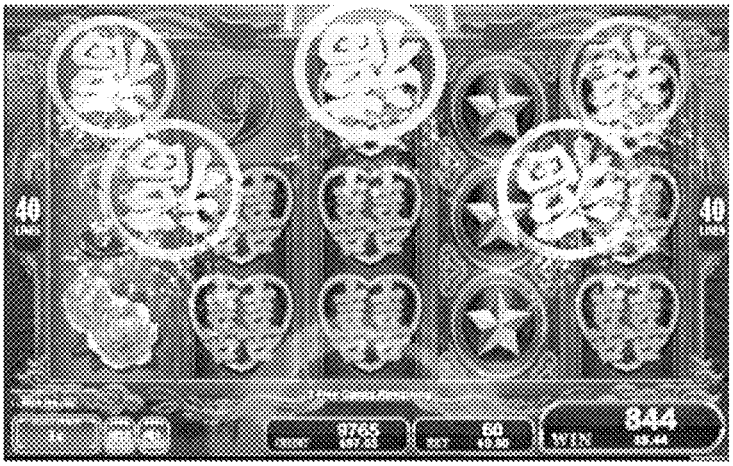

Turning to FIG. 7B, if the multi-step feature is triggered, then a celebratory animation 72 is displayed. As discussed below, in one embodiment, the number and placement/location of the replacement symbols are randomly determined. After the replacement symbols are established, the replacements symbols are divided into two groups. Once the replacement symbols have been divided into two groups, a determination, based on the effect of the replacement symbols on the payout or award, is made to: (1) show the placement of the replacement symbols in one feature or feature animation, or (2) show the placement of the first group of replacement symbols in a first feature or feature animation, and the placement of the second group of replacement symbols in a second feature or feature animation.

As shown in FIG. 7A, the initial or interim outcome of the game includes a symbol in each one of the cells 64 of the grid 60. In the illustrated embodiment, each one of the cells 64 of the fourth column or reel contain a Wild symbol (shown as a star within a circle).

Figure 7D:
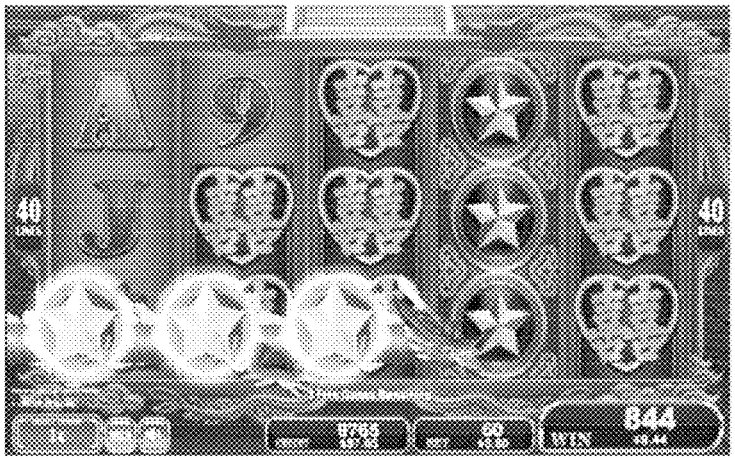
Figure 7E:
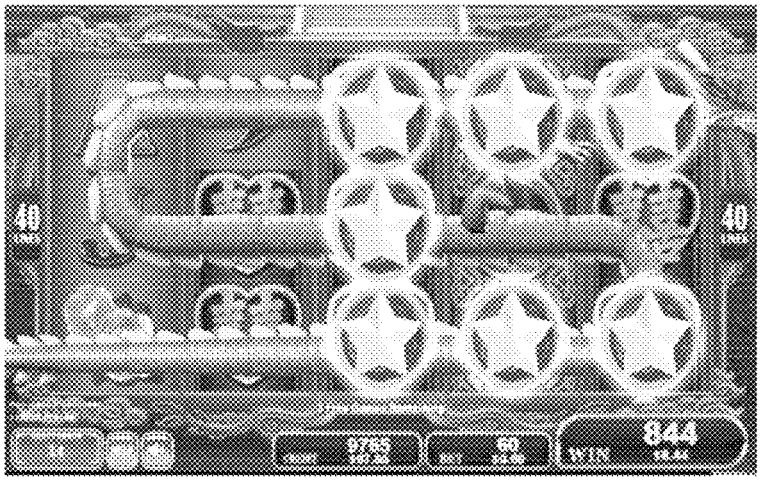

In the illustrated embodiment, a first variable reel 74 and a second variable reel 76 are displayed in first and second feature animations, respectively, to deposit the extra symbols, shown as Wild symbols. In the illustrated embodiment, the first and second variable reels 74, 76 are shown as a dragon or dragon reels. As discussed more fully below, each variable reel includes a predetermined number of symbol positions. Each symbol position is populated either with a replacement symbol, or a null or blank symbol. Each symbol position corresponds to one of the cells 64 of the grid 60. If a symbol position of the variable reel includes a replacement symbol, then at the end of the respective feature animation, the replacement symbol will replace the original symbol from the first set of symbols. However, if the symbol position includes a null or blank symbol, then the original symbol from the first set of symbols will remain and be included in the final outcome. As shown in FIGS. 7D and 7E, the first variable or dragon reel 74 deposits seven replacement symbols (shown as Wild symbols that are highlighted in FIG. 7E).

Figure 7F:
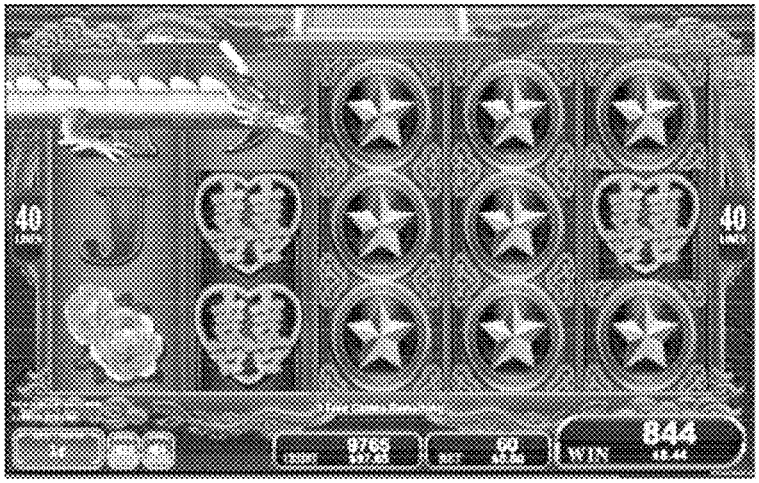
Figure 7G:
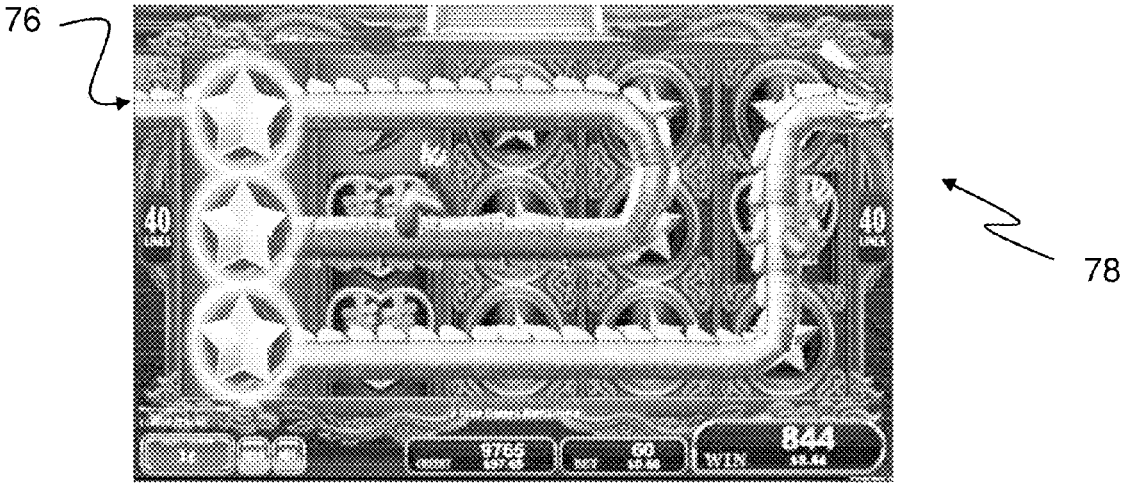
Figure 7H:
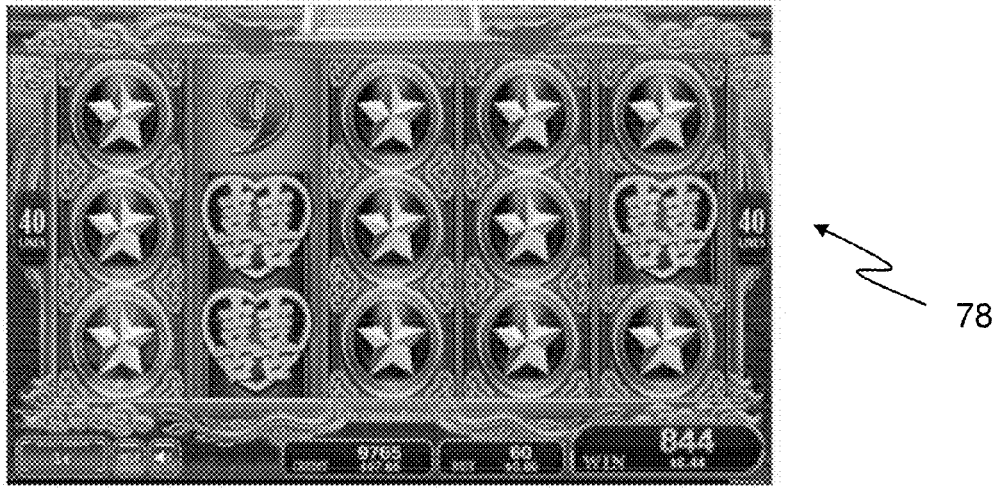

Once the first feature animation has completed, the second variable reel 76 is displayed in a second feature or feature animation (see FIGS. 7F and 7G). As shown in the example of FIGS. 7F and 7G, the second variable reel 76 deposits extra replacement symbols shown as Wild symbols, in all of the cells 64 of the first column or reel of the grid. It should be noted that the first and second variable reels 74, 76 may traverse across the grid in different patterns (see below). As shown in FIG. 7H, the final outcome of the game includes the replacement symbols and any remaining, i.e., not-replaced, symbols from the first set of symbols.

As stated above, the control unit 50 randomly establishes a set of replacement symbols. Each symbol in the set of replacement symbols is associated with one of the plurality of cells in the group and is adapted to replace the symbol from the first set of symbols associated with the respective cell in the grid. The set of replacement symbols may be determined using any suitable method.

In one embodiment of the present invention, the replacement symbols are all Wild symbols. In another embodiment of the present invention, the replacement symbols are the same symbol and may be randomly chosen from a set of available symbols. In still another embodiment of the present invention, the replacement symbols are individually chosen, and thus, each replacement symbol may be the same or different from another one of the replacement symbols.

As discussed above, in one embodiment of the present invention, each variable reel includes a plurality of symbol positions. In one embodiment, the number of symbol positions on the variable reels is equal to the number of cells 64 in the grid 60. In the illustrated embodiments, the grid 60 includes cells 64. Thus, each variable reel includes 15 symbol positions.

With respect to FIG. 8A, in one embodiment, each cell 64 of the grid 60 has a reference number (1-15) and a probability associated with the cell. The associated probability is indicative of the possibility that a replacement symbol will appear in the respective cell. In the illustrated embodiment, each cell 64 may have a probability that differs from the probability associated with another one of the cell 64. In another embodiment, the probability associated with each cell is the same. The appearance of a replacement symbol in each cell is determined using the RNG. Thus, a separate determination for each cell is made.

Figure 8B:
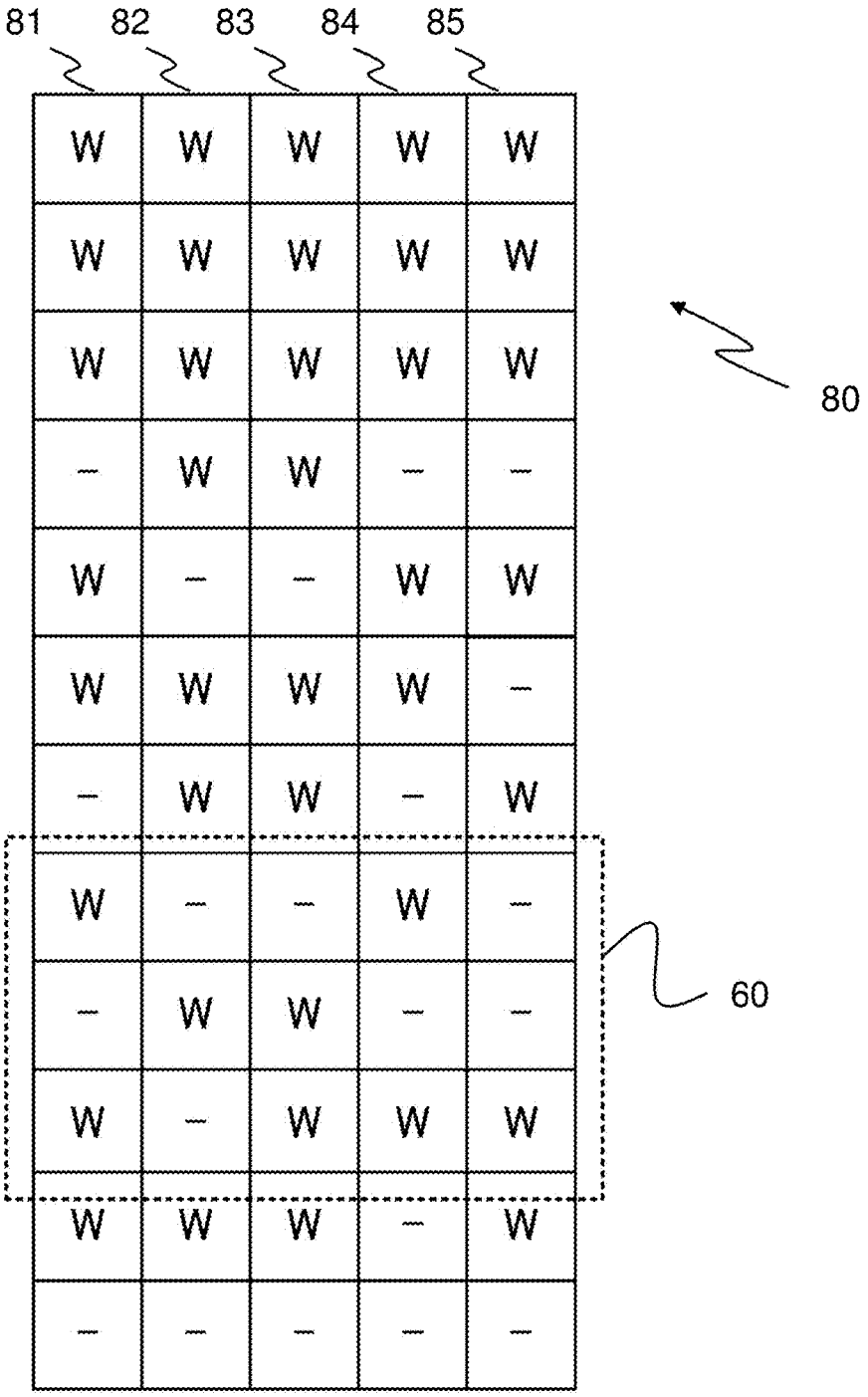
FIG. 8B is an illustration of non-visible vertical reels, according to another embodiment of the present invention.

With respect to FIG. 8B, in another embodiment, the placement of the replacement symbols are determined utilizing virtual (non-visible) vertical reels 80. The data for the vertical reels are stored in memory. In the illustrated embodiment, each column of the grid 60 has an associated virtual vertical reel 81, 82, 83, 84, 85. Each reel may have a weighted stop probability, i.e., one of the stop positions of one of the reels 81-85 may have a different probability than another one of the stop positions on the one of the reels. The RNG is used to establish a stop position for each virtual vertical reel 81-85. Each reel has a pattern of replacement or wild symbols and blanks. The control unit 50 uses the RNG to determine an independent stop position for each virtual non-visible vertical reel. Thus, 5 separate, independent random numbers from the RNG are used. The resulting pattern (see FIG. 8B) forms the set of replacement symbols.

Figure 8C:
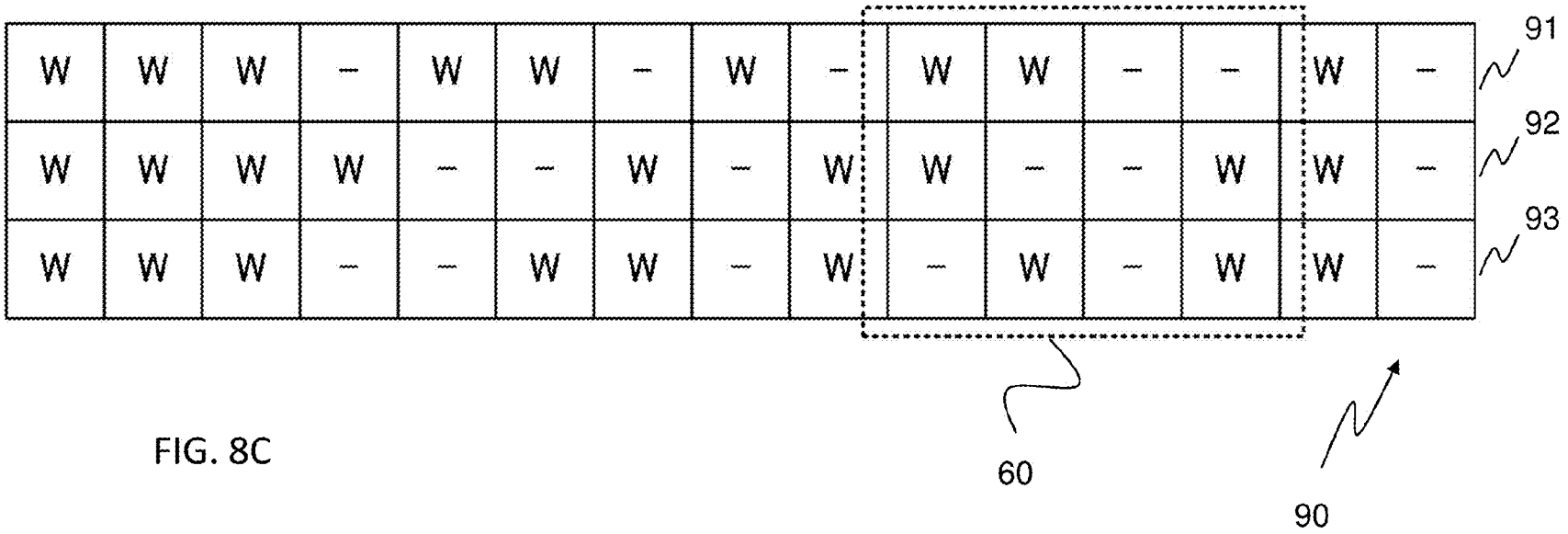
FIG. 8C is an illustration of non-visible horizontal reels, according to a further embodiment of the present invention.

With respect to FIG. 8C, in another embodiment, the placement of the replacement symbols are determined utilizing virtual (non-visible) horizontal reels 90. The data for the horizontal reels are stored in memory. In the illustrated embodiment, each row of the grid 60 has an associated virtual horizontal reel 91, 92, 93. Each reel may have a weighted stop probability, i.e., one of the stop positions of one of the reels 91-93 may have a different probability than another one of the stop positions on the one of the reels. The RNG is used to establish a stop position for each virtual horizontal reel 81-85. Each reel has a pattern of replacement or wild symbols and blanks. The control unit 50 uses the RNG to determine an independent stop position for each virtual non-visible vertical reel. Thus, 3 separate, independent random numbers from the RNG are used. The resulting pattern (see FIG. 8C) forms the set of replacement symbols.

Figure 8D:
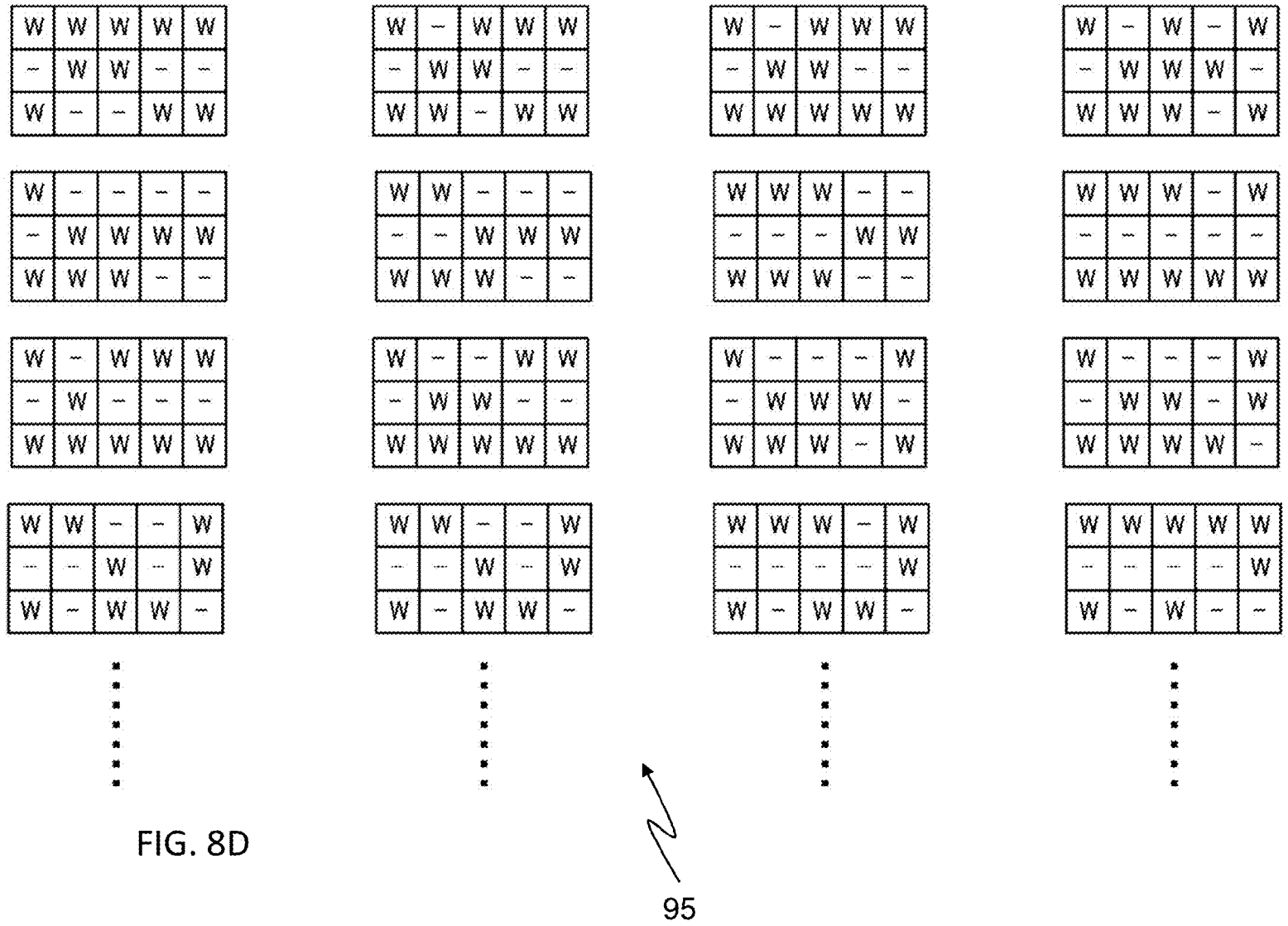
FIG. 8D is a set of extra wild symbols patterns, according to still another embodiment of the present invention.

With respect to FIG. 8D, in another embodiment, the control unit 50 establishes the replacement symbols by selecting a predetermined pattern of replacement symbols from a set of predetermined patterns of replacement symbols 95. The data for each of the predetermined patterns in the set of patterns are stored in memory. In one embodiment, each predetermined pattern of replacement symbols in the set of predetermined patterns has an equal probability. In another embodiment, each predetermined pattern may have a different probability than another one of the predetermined patterns.

Figure 9:
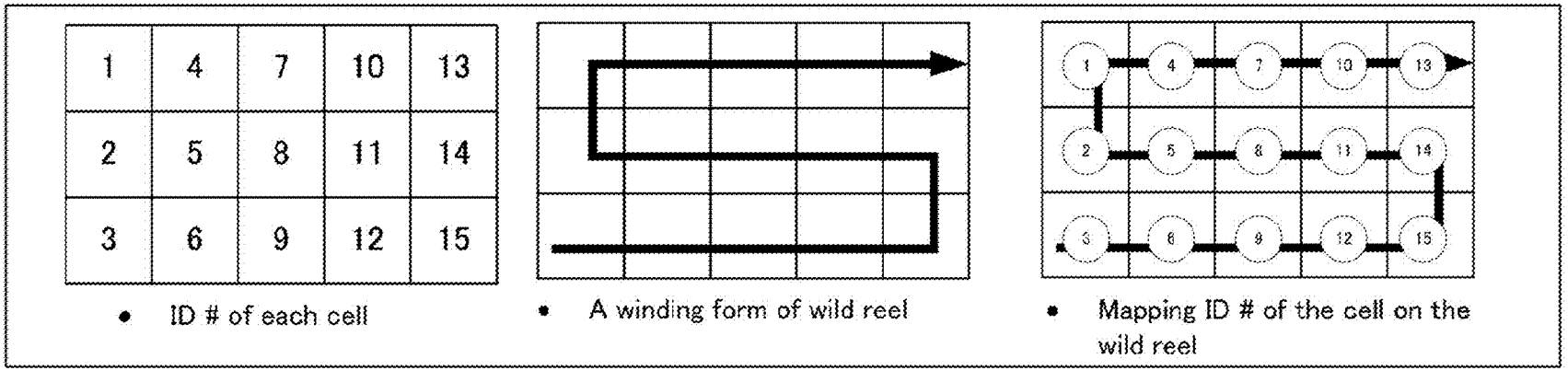
FIG. 9 is a diagrammatic illustration of a mapping of a variable reel strip to the cells of the grid of the display area, according to an embodiment of the present invention.
Figure 10:
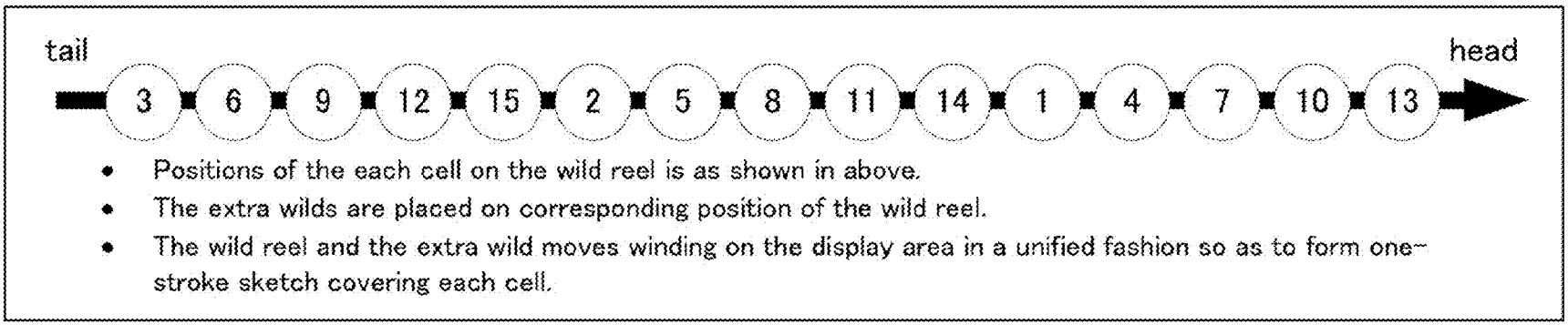
FIG. 10 is a diagrammatic illustration of the variable reel strip having a plurality of symbol positions, according to an embodiment of the present invention.

In one aspect of the present invention, the variable reel is shown as traversing the grid 60 in a predetermined pattern. In one embodiment, the pattern is always the same. In another embodiment of the present invention, the pattern may vary between the unified variable reel, the first variable reel, and the second variable reel. For instance, the pattern may be randomly (or in a predetermined sequence) selected from a set of predefined patterns. Once the pattern is determined, the replacement symbols or replacement Wild symbols are mapped to the variable reel based on the location on the grid 60 and the selected predefined pattern. The process is illustrated in FIG. 9. In the left graphic, each cell 64 of the grid 60 has an associated reference or identification number. The selected pattern or winding form of the variable wild reel is shown in the middle graphic. The identification numbers and the selected pattern are merged in the right graphic. As mentioned above, in one embodiment each variable reel has a number of symbol positions equal to the number of cells in the grid. Based on the selected pattern and the patterns of replacement symbols on the grid, the identification numbers are mapped to the symbol positions on the variable reel (see FIG. 10).

The extra or replacement symbols on the grid are placed within the corresponding position on the variable reel. If a unified variable reel is used (see below), then all of the replacement symbol or replacement Wild symbols are mapped to the unified variable reel. If a unified variable reel is not used (see below), then the first group of replacement symbols are mapped to a first variable reel and the second of replacement symbols are mapped to a second variable reel. The unified variable reel or the first and second variable reels are then displayed as moving in the selected respective pattern on the display 28 in a fashion so as to form a one-stroke sketch covering each cell 64 in the grid 60.

Figure 11:
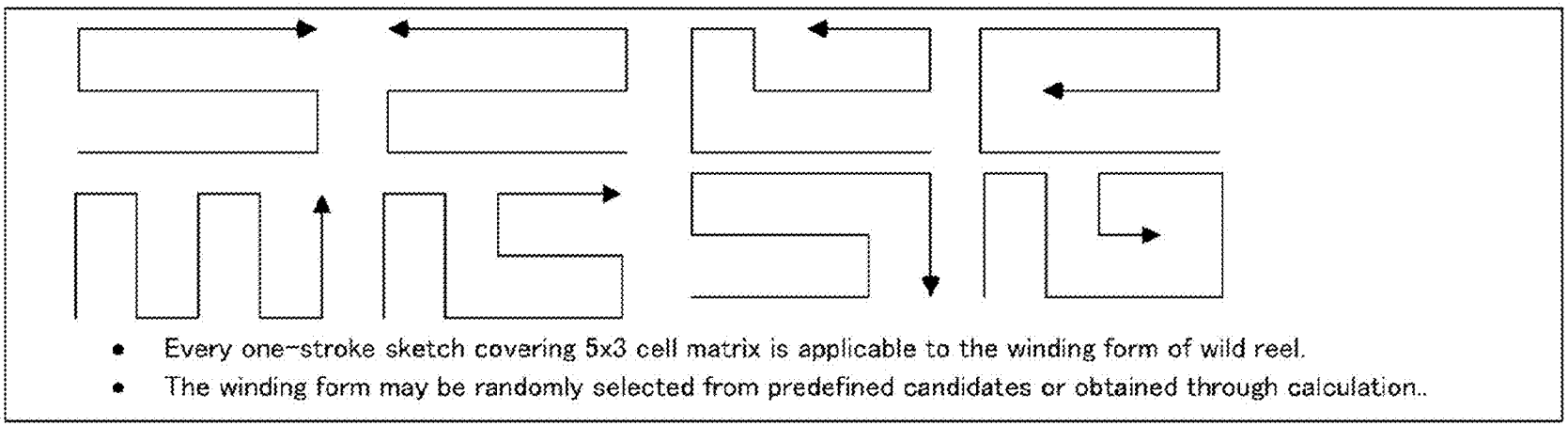
FIG. 11 is a diagrammatic illustration of a set of potential variable reel strip patterns, according to an embodiment of the present invention.

The mapping of the identification numbers of the cells to the symbol positions on the variable reel will change based on the selected pattern. As discussed above, the pattern associated with the variable reel, or the first and second variable reels may be selected (randomly or in sequence) from a set of potential patterns. An exemplary set of patterns is shown in FIG. 11.

Figure 12A:
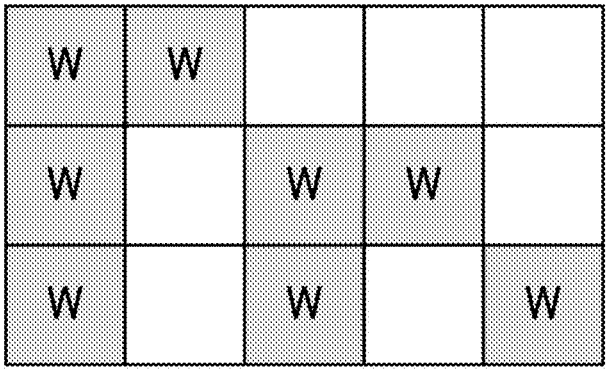
FIG. 12A is an exemplary pattern of extra wilds to be added to the display area, according to an embodiment of the present invention.
Figure 12B:
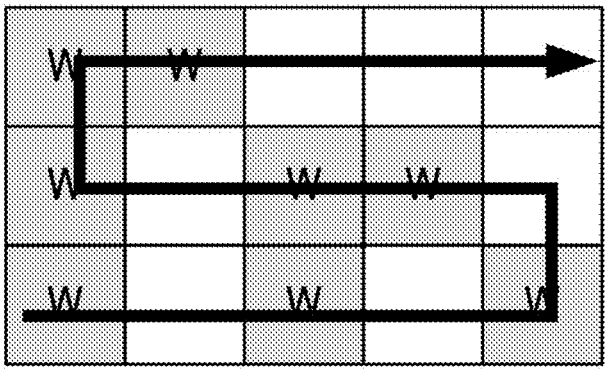
FIG. 12B is an exemplary variable reel strip pattern applied to the pattern of extra wilds of FIG. 12A.
Figure 12C:
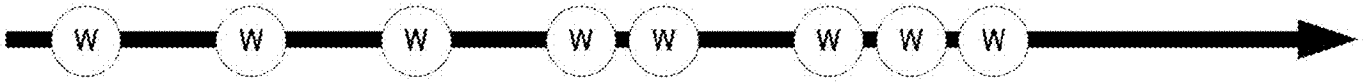
FIG. 12C is a diagrammatic illustration of the extra wilds on a variable reel strip, according to FIGS. 12A and 12B.

An example of the mapping process for a sample set of replacement Wild symbols is shown in FIGS. 12A and 12B. In FIG. 12A, a set of replacement Wild symbols is established in the illustrated cells 64 of the grid 60. In this illustration, the replacement Wild symbols in the set of replacement symbols are mapped to a single or unified variable reel. The replacement Wild symbols are then mapped to the symbol positions on the variable reel to form the variable reel (see FIG. 12C).

Figure 13A:
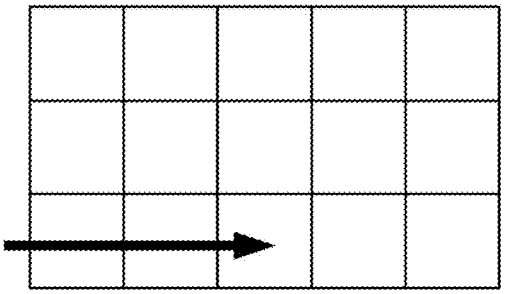
FIGS. 13A-13F are diagrammatic illustrations of a unified variable reel strip traversing the cells of a grid depositing extra wilds in the respective cells, according to an embodiment of the present invention.
Figure 13B:
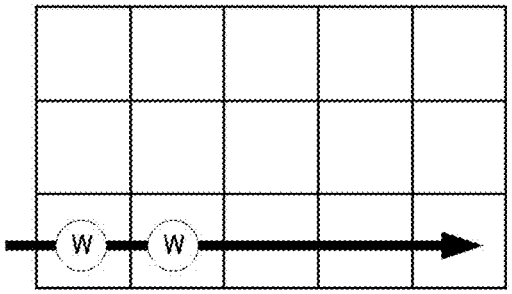
Figure 13C:
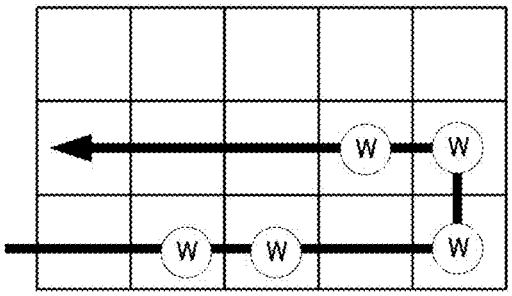
Figure 13D:
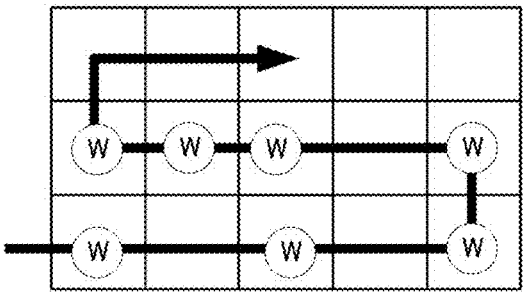
Figure 13E:
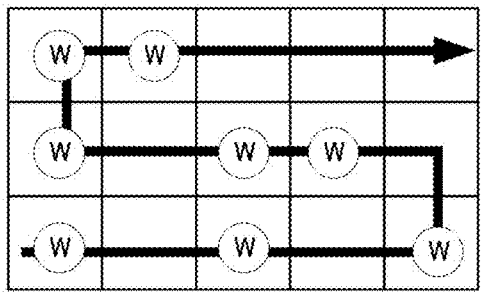
Figure 13F:
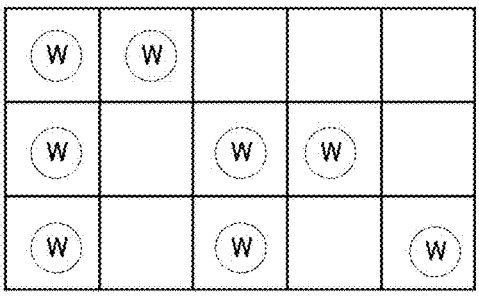
Figure 14A:
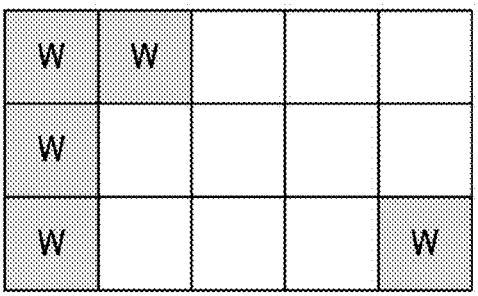
FIGS. 14A-14B are diagrammatic illustrations of a first group of extra wild symbols in the respective cells and a selected variable reel strip pattern, according to an embodiment of the present invention.
Figure 15A:
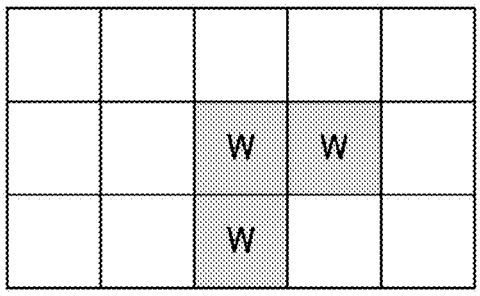
FIGS. 15A-15B are diagrammatic illustrations of a second group of extra wild symbols in the respective cells and a selected variable reel strip pattern, according to an embodiment of the present invention.
Figure 14B:
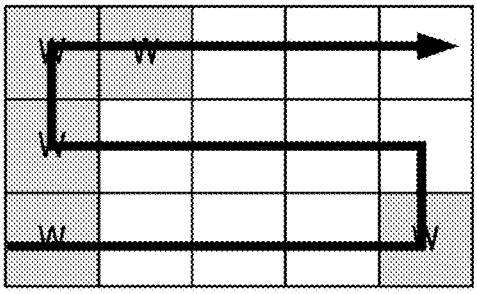
Figure 15B:
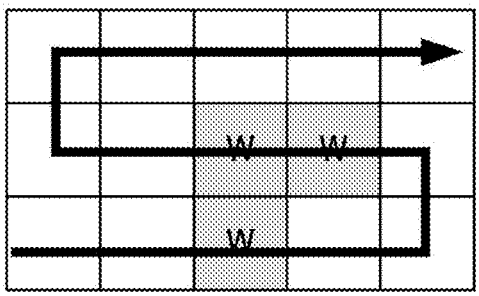

With reference to FIGS. 13A-13F, the motion of the unified reel as the unified reel traverses the grid 60 in the selected pattern is shown. As shown in FIG. 13A, the variable reel appears in the display unit 28 and moves in a winding fashion (FIGS. 13B-13E). After the positioning of the replacement Wild symbols on the corresponding cells 64 of the grid 60 (FIG. 13E, the variable reel exits from the display unit 28, leaving the replacement symbols on the corresponding cells 64 of the grid 60 (see FIG. 13F).

Figures 16A, 16B:
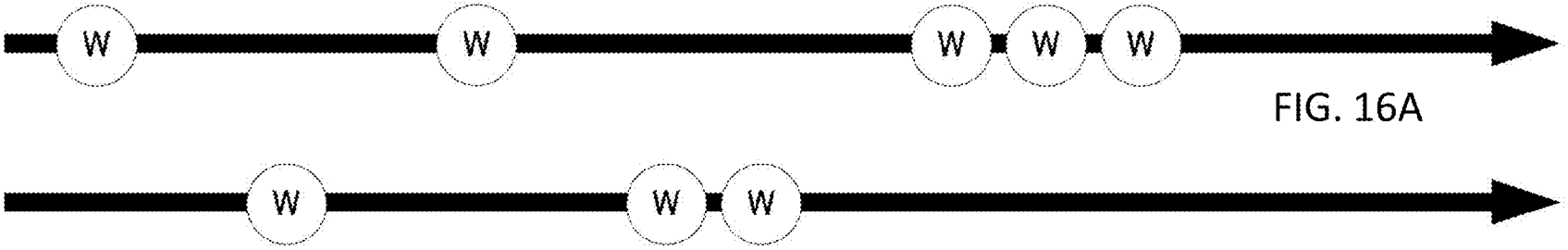
FIG. 16A is a diagrammatic illustration of the first group of extra wild symbols on the first variable reel strip of FIGS. 14A and 14B.
FIG. 16B is a diagrammatic illustration of the second group of extra wild symbols on the second variable reel strip of FIGS. 15A and 15B.

After the set of replacement symbols (or replacement Wild symbols) are established, then the set of replacement symbols are divided into groups, for example, first and second groups. In one embodiment, as discussed more fully below, the control unit 50 makes a determination to either display the placement of the replacement symbols in the associated cells 64 of the grid 60 using a unified variable reel, or first and second variable reels. If the control unit 50 determines that the placement of the replacement symbols in the associated cells 64 of the grid 60 is to be displayed using the first and second reels, then the replacement symbols are divided into groups of replacement symbols. With reference to FIGS. 14A, 14B, 15A, 15B, 16A, 16B, 17A, 17B, 17C, 18A, 18B, 18C, in the illustrated embodiment, the replacement symbols are divided into two groups: a first group of replacement symbols and a second group of replacement symbols. The method used to group the replacement symbols into two groups is discussed more fully below. In the illustrated embodiment, the set of replacement symbols from the previous example shown in FIG. 12A are divided into a first group of replacement symbols (shown in FIG. 14A) and a second group of replacement symbols (shown in FIG. 15A). A respective pattern for the first and second group is then established (see above). For the purposes of discussion, in this embodiment, the same pattern is used for both the first and second variable reels. The replacement Wild symbols are mapped to the first variable reel (see FIG. 14B) and to the second variable reel (see FIG. 15B). From the mapping, the replacement (or replacement Wild) symbols are positioned on the first and second variable reels, as shown in FIG. 16A and FIG. 16B, respectively.

The first and second variable reels are then displayed using the first and second features (or feature animations), respectively. In the illustrated embodiment, the first and second features are shown consecutively. However, it should be noted that the first and second features may be displayed simultaneously, or at least partially overlap.

Figure 17A:
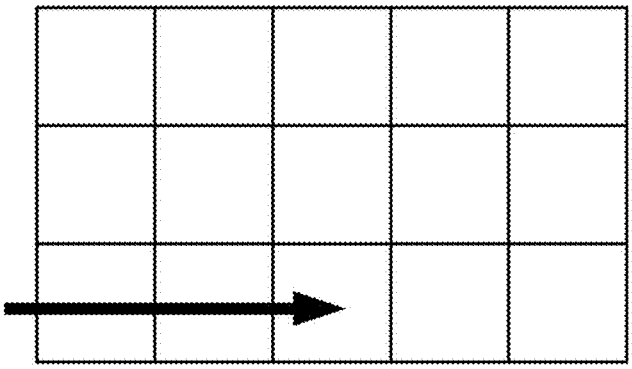
FIGS. 17A-17C are diagrammatic illustrations of a first variable reel strip traversing the cells of the grid depositing a first group of extra wild symbols in the respective cells, according to an embodiment of the present invention.
Figure 17B:
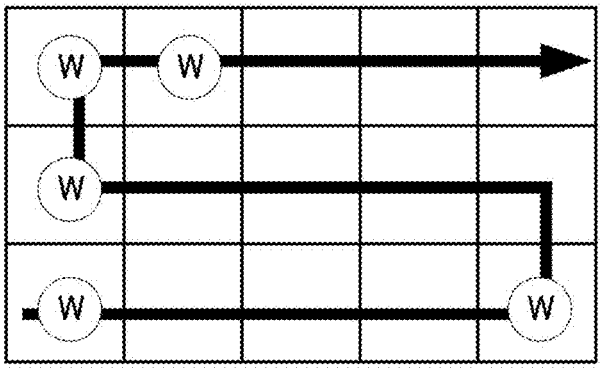
Figure 17C:
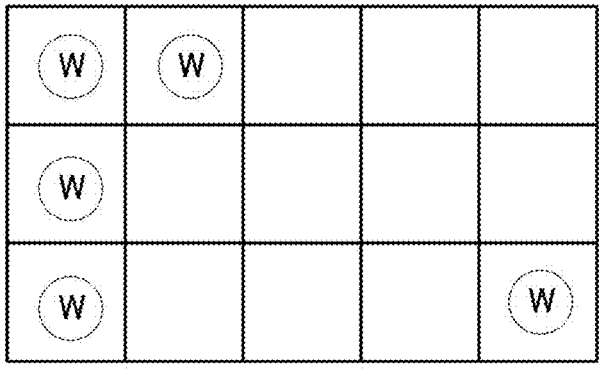

With reference to FIGS. 17A-17C, the first feature animation is displayed in a series of graphical images. In FIG. 17A, the first variable reel appears in the display area (of lower display 24) from the left side. The first variable reel moves in a winding fashion, following the associated pattern, FIG. 17B. After positioning each replacement Wild symbol on the corresponding cell 64 of the grid, the first variable reel exits the display area, leaving the replacement Wild symbols in place on the respective cells 64 of the grid 60 (see FIG. 17C).

Figure 18A:
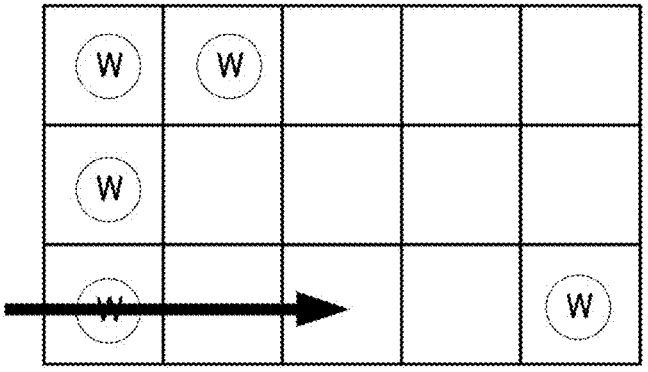
FIGS. 18A-18C are diagrammatic illustrations of a second variable reel strip traversing the cells of the grid depositing a second group of extra wild symbols in the respective cells, according to an embodiment of the present invention.
Figure 18B:
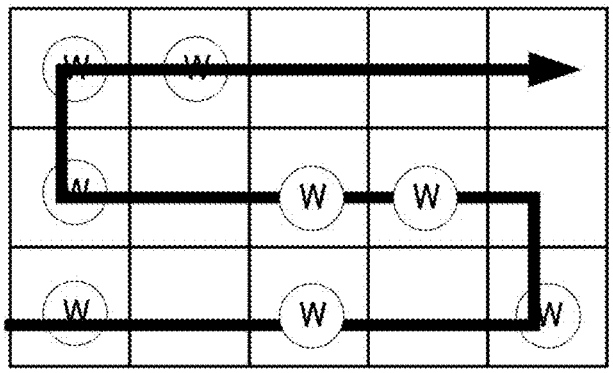
Figure 18C:
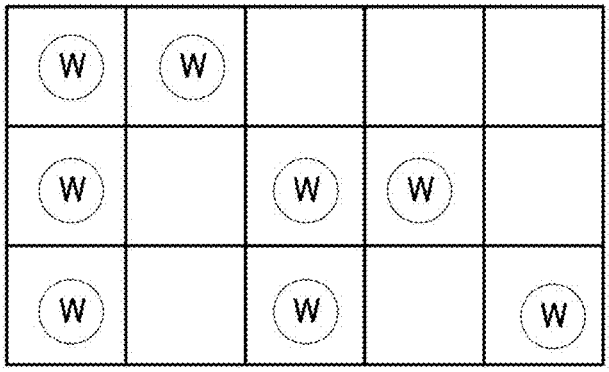

With reference to FIGS. 18A-18C, the second feature animation is displayed in a series of graphical images. In FIG. 18A, the second variable reel appears in the display area (of lower display 24) from the left side. The second variable reel moves in a winding fashion, following the associated pattern, FIG. 18B. After positioning each replacement Wild symbol on the corresponding cell 64 of the grid, the second variable reel exits the display area, leaving the replacement Wild symbols in place on the respective cells 64 of the grid 60 (see FIG. 18C).

As described above in one aspect of the present invention, the set of replacement symbols may be divided into groups, e.g., first and second groups. With reference to FIG. 19A, an exemplary set of replacement symbols is graphically shown. In one embodiment, the set of replacement symbols are divided into groups based on a predetermined set of cell groupings. In one example, each set of cell groupings includes a first grouping of cells and a second grouping cells. One of the cell groupings from the set of cell groupings is selected and the replacement symbols in the respective cells of the first grouping of cells are placed in the first group of replacement cells. The replacement symbols in the respective cells of the second grouping of cells is placed in the second group of replacement cells.

In one embodiment, the grouping of cells are based on columns. One embodiment is illustrated in FIG. 19B. In the illustrated embodiment, the set of cell groupings includes 15 sets of groupings (or manners). For example, in one illustrated embodiment, each grouping includes a Group 1 of columns or reels and a Group 2 of column or reels. FIGS. 19C and 19D illustrate an exemplary set of replacement symbols divided into a first group of replacement symbols (FIG. 19C) and a second group of replacement symbols (FIG. 19D) using the first of groupings shown in FIG. 19B.

In one aspect of the present invention, the grouping used may be randomly determined from the set of groupings. Alternatively, the grouping used may be selected in order, or in another predetermined pattern.

After the replacement symbols have been divided into groups, the first group of replacement symbols may then be displayed utilizing a first feature or first feature animation. The second group of replacements symbols may then be displayed utilizing a second feature animation. The outcome of the game is formed from the set of replacement symbols (in the corresponding cells 64 of the grid 60) and any remaining symbols in the first set of symbols. A payout may be awarded to the player as a function of the outcome of the game, a wager made by the player, and a corresponding pay table.

In another aspect of the present invention, the set of replacement symbols are divided into an interim first group of replacement symbols and an interim second group of replacement symbols. Estimated payouts or awards to the player are evaluated based on the interim first and second groups of symbols.

In one embodiment, if the estimated payouts meet predetermined criteria, then the replacement symbols are positioned or displayed on the grid 60 using the first and second features, i.e., the first and second variable reels, as described above. If the estimated payouts do not meet the predetermined criteria, then the replacement symbols are positioned or displayed on the grid 60 using a single feature or feature animation, i.e., the unified variable reel (see above).

In another embodiment, if the estimated payouts do not meet the predetermined criteria, then another set of interim first and second groups of replacement symbols are chosen from the set of groups (see FIG. 19B). If the estimated payouts based on the new groupings do not meet the predetermined criteria, then another set of interim groups of replacement symbols are chosen. This is repeated for a predetermined number of times, e.g., 15, then the replacement symbols are positioned or displayed on the grid 60 using a single feature or feature animation, i.e., the unified variable reel (see above).

In one embodiment, the predetermined criteria is defined as: $\text{estimated_payout}_1/\text{estimated_payout}_2 > M$, where $\text{estimate_payout}_1$ is the estimated payout based on the outcome of the game, i.e., the set of replacement symbols and any remaining symbols from the first set of symbols, where $\text{estimated_payout}_2$, is the estimated payout based on the interim first group of replacement symbols and any remaining symbols from the first set of symbols, and M is a predetermined constant, e.g., 20.

Using the above method, if the addition of the second group of replacement symbols has a great effect on the payout to the player, then by dividing the set of replacement symbols into two groups, showing the replacement of some of the symbols in the first set of symbols by the symbols in the first group of replacement symbols using a first feature animation and the first interim group of symbols, and showing the replacement of others of the symbols in the first set of symbols by the symbols in the second group of replacement symbols using a second feature animation, then anticipation and excitement in the player are increased. This follows by a large win, e.g., >Mx, for the player. If, however, the difference between an estimated payout based on the first set of replacement symbols and the payout based on the combined first and second sets of replacement symbols is not as great, i.e., does not meet the predetermined criteria, the player may be frustrated or annoyed as a result of the separated feature animations. In this situation, the replacement of some of the symbols in the outcome based on the first set of symbols by the set of replacement symbols is displayed using a single feature animation.

In one embodiment, the first feature or feature animation is displayed while the rotating reels are spinning. The second feature may be displayed while the rotating reels are spinning, or after the rotating reels are stopped.

Alternatively, the first and second features may be displayed after the rotating reels are stopped.

In another aspect of the present invention, a control method for a gaming machine 10 to provide a game to a player is provided. The gaming machine 10 includes a control unit 50, an operation unit 36, and a display unit 28. The operation unit 36 is configured to receive operation from the player. The display unit 28 is operably coupled to the operation unit 36 and is configured to display a plurality of cells 64. The plurality of cells 64 are arranged in a plurality of rows and columns. The control unit 50 is operably coupled to the operation unit 36 and the display unit 28, and provides a primary game and a bonus game. For each instance of the primary game, the control unit 50 is configured to randomly establish a symbol to be displayed within each of the plurality of cells of the primary display area 60. The bonus game may be, for example, a number of free spins. During either the primary game or one of the free spins of the bonus game, a multi-step feature may be provided.

In one embodiment, if a trigger condition is detected (either in the primary game or one of the free spins), then the multi-step feature game is initiated. In general, the control method operates on a gaming machine to provide a game to a player. The gaming machine includes an operation unit, a display unit, and a control unit. The operation unit is configured to receive an operation of the player. The display unit is operably coupled to the operation unit and is configured to display a symbol display area. The symbol display area includes a plurality of cells arranged in a grid. The control unit is operably coupled to the operation unit and the display unit and is configured to initiate a game in response to player operation and to establish an outcome of the game. A first set of symbols associated with the symbol display area is established. Each symbol in the first set of symbols is associated with one of the plurality of cells in the group. A set of replacement symbols is randomly established. Each symbol in the set of replacement symbols is associated with one of the plurality of cells in the group and is adapted to replace the symbol from the first set of symbols associated with the respective cell in the grid. The set of replacement symbols are divided into a first group of replacement symbols and a second group of replacement symbols. The replacement symbols may then be displayed in the display area of the display unit using first and second features (or feature animations), or using a unified feature (or feature animation). The replacement symbols replace (at least) some of the symbols in the first set of symbols. The outcome of the game is composed of the set of replacement symbols and any remaining, i.e., non-replaced, symbols from the set of first symbols. A payout (or award), may then be paid to the player as a function of the outcome.

With reference to FIGS. 20A, 20B, 20C and 21, an exemplary flow diagram of a method for operating the gaming machine 10 is shown, according to an embodiment of the present invention.

In the illustrated embodiment, a primary game is initiated. In a first step S1, reels 1-5 are spun. In a second step S2, a random number associated with each reel is randomly determined. In a third step S3, the stop position for each reel as a function of the associated random number is determined. The symbols defined, i.e., the first set of symbols, are displayed in the determination area or grid 60 form an initial outcome.

In a fourth step S4, a determination is made if a trigger condition has occurred. If the trigger condition has occurred, then the method proceeds to a fifth step S5. Otherwise, the control method proceeds to a twelfth step S12 (see below).

In one embodiment, the trigger condition is a mystery trigger determined by a random number from the RNG. The mystery trigger is independent of the first set of symbols or initial outcome. In another embodiment, the trigger condition is a function of the initial outcome. For example, the trigger condition may be the appearance of one or more designated symbols in the outcome. In still another embodiment, the trigger condition may be an external event. For example, the trigger condition may be triggered by the player ranking or tracking system 57, or by a casino management system. In a further embodiment, the trigger may be based on the play history of the player, e.g., the play history during the current session.

In the fifth step S5, the extra wild pattern is established (see above). In a sixth step S6, the control method determines if a predetermined condition has been met. If the predetermined condition has been met, then the control method proceeds to a sixteenth step S16. If the predetermined condition has not been met, then the control method proceeds to a seventh step S7. In general, if the predetermined condition has been met, then the replacement (of at least some) of the symbols in the first set of symbols with the replacement symbols is displayed using at least two features or feature animations. If the predetermined condition has not been met, then the replacement of (at least some of) the symbols in the first set of symbols with the replacement symbols is displayed using a unified feature or feature animation (see above).

In the seventh step S7, the winding form, i.e., pattern, for the unified variable reel is determined (see above). Based on the determined pattern and the pattern of replacement wild symbols, the positions of the replacement wild symbols on the unified variable reel, i.e., wild reel, are determined in an eighth step S8. In a ninth step S9, reels 1-5 are stopped and in the initial outcome, i.e., the first set of replacement symbols, are displayed.

In a tenth step S10, the unified feature is displayed using the unified variable reel or wild reel and the modified outcome, i.e., the set of replacement symbols and any remaining symbols from the first set of symbols, are displayed in the eleventh step S11.

The modified outcome is compared with a predetermined pay table and (played) pay lines. If the modified outcome forms a winning outcome or combination (S12), then in a thirteenth step S13, an award is paid to the player. If the modified outcome is not a winning combination, then the method proceeds to S14.

In the illustrated embodiment, the multi-step feature is provided within a primary game. The primary game may also trigger one or more free spins as a bonus game. So, in the fourteenth step S14, if a free spin trigger condition has occurred, then a number of free spins are provided in a fifteenth step S15.

Figure 20A:
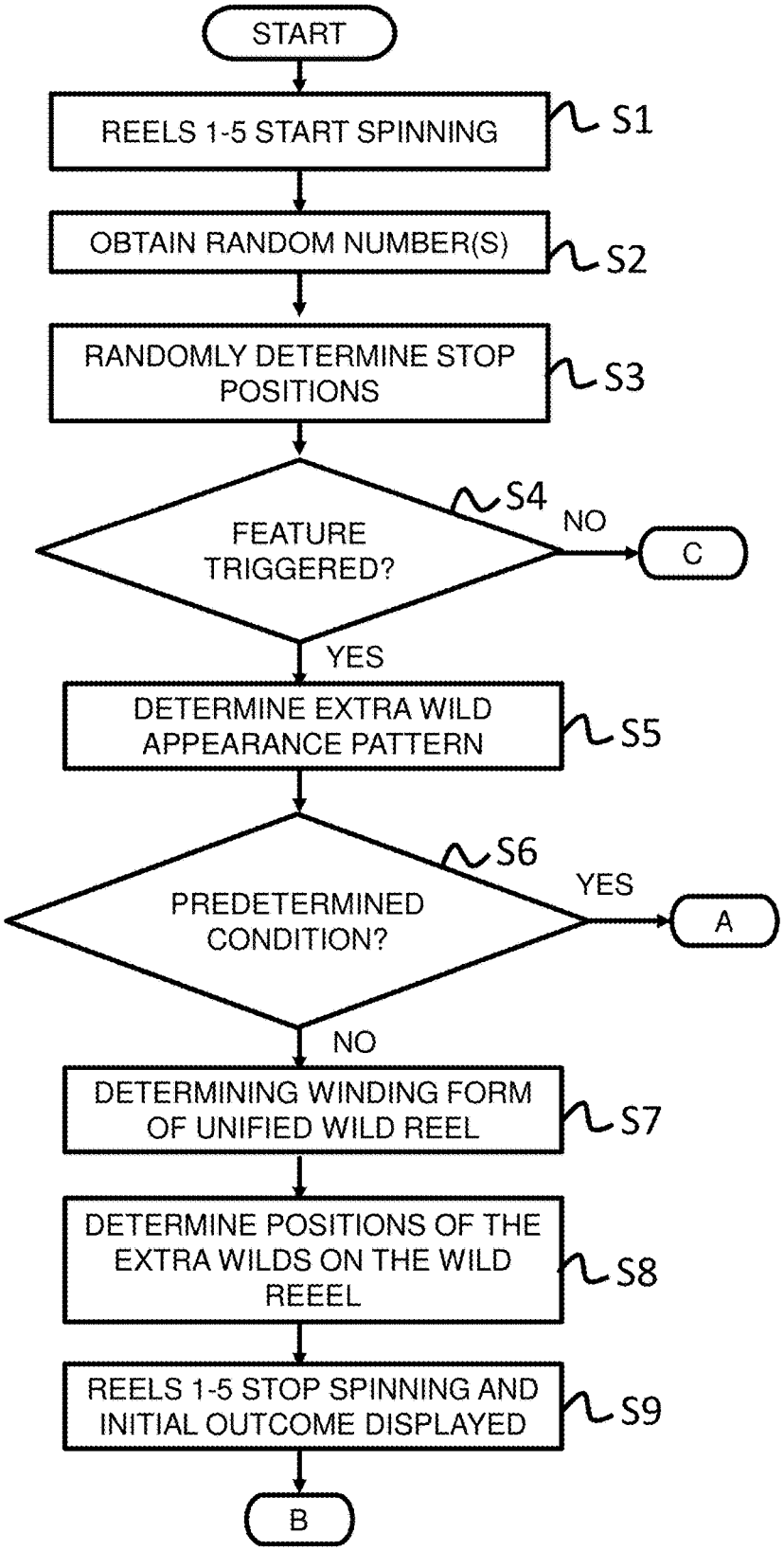
FIGS. 20A-20C are portions of a flow chart describing the operation of the gaming machine in FIG. 1, according to one embodiment of the present invention.
Figure 20B:
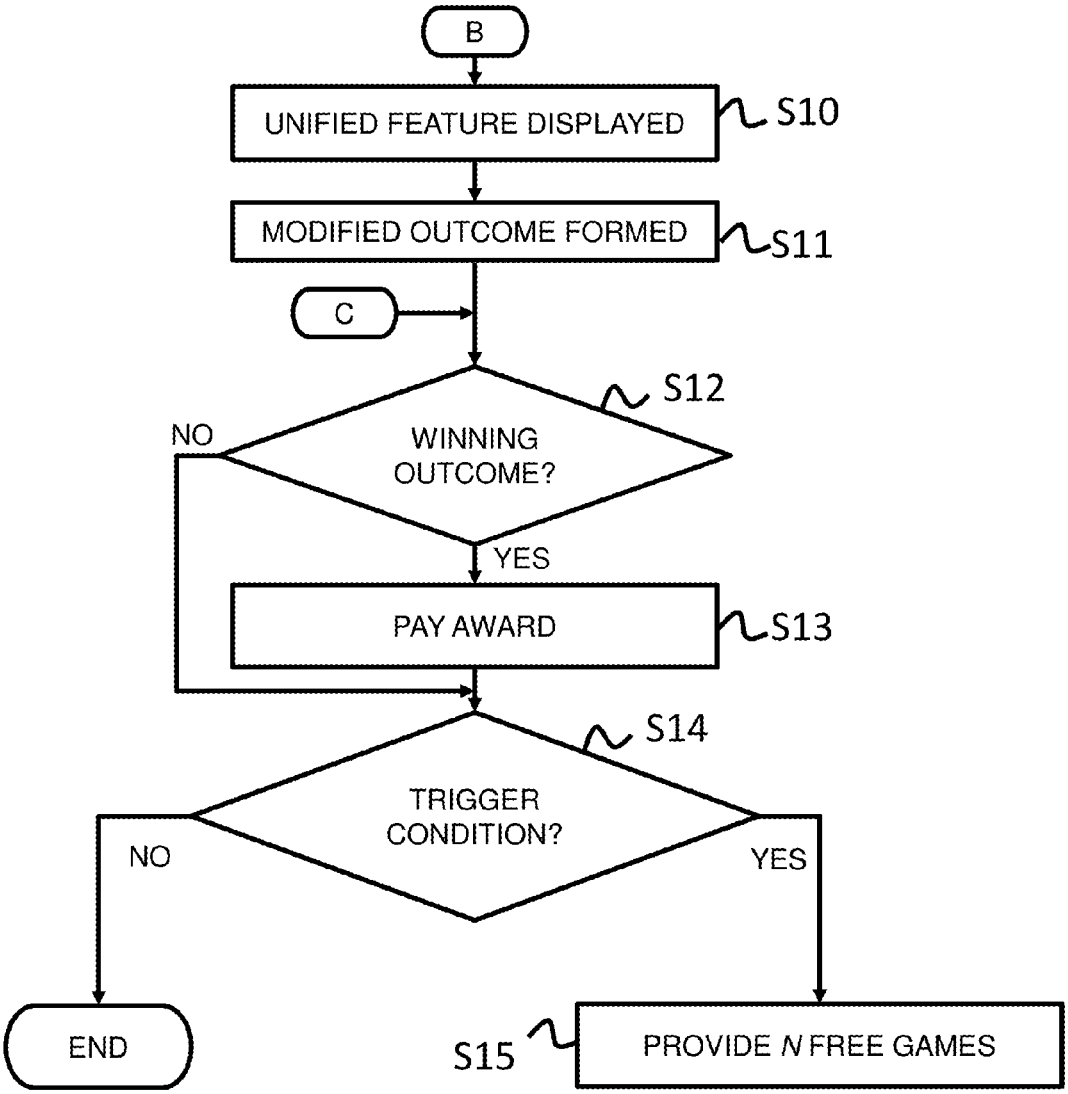
Figure 20C:
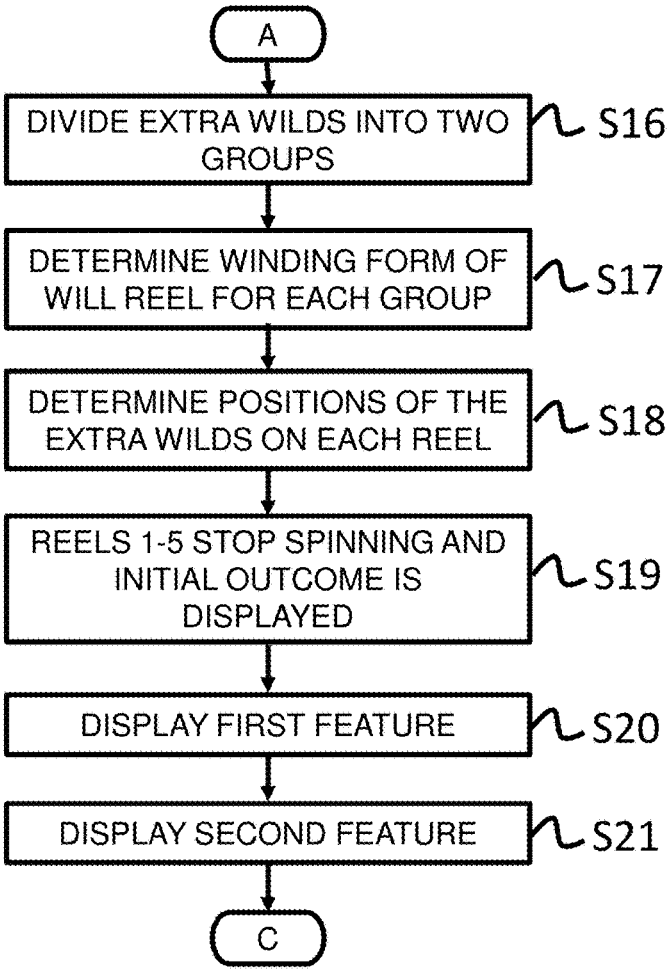

With reference to FIG. 20C, if the predetermined condition has been met in step S6, then the replacement of (at least some of) the symbols in the first set of symbols with the replacement symbols is shown using the first feature or feature animation, and the second feature or feature animation. In a sixteenth step S16, the extra wild symbols are divided into the first and second groups of replacement symbols. A winding form or pattern is determined for the first and second feature animations in a seventeenth step S17. In an eighteenth step S18, the positions of the replacement symbols, i.e., extra wilds or wild symbols, are determined based on the determined patterns. In a nineteenth step S19, the reels 1-5 are stopped and an initial outcome, based on the first set of symbols, is displayed.

In a twentieth step S20, the first feature or feature animation is displayed using the first variable reel and in a twenty-first step S21, the second feature or feature animation is displayed using the second variable reel, then the control method proceeds to the twelfth step S12 (see above).

Figure 21:
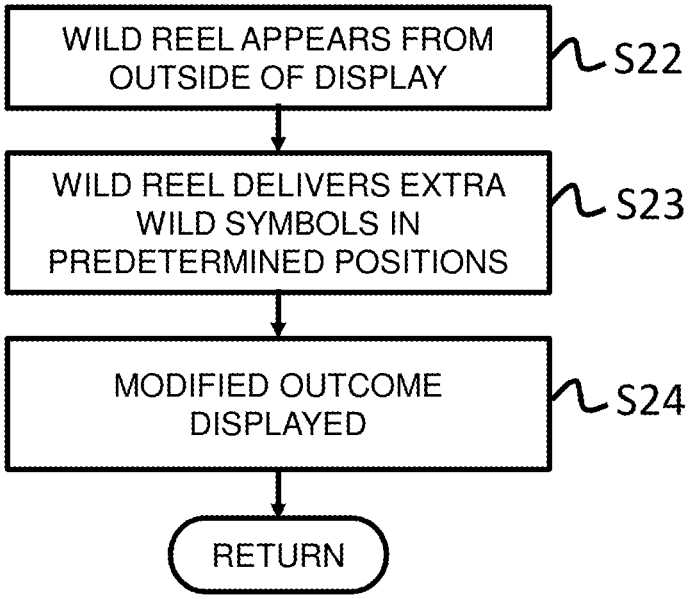
FIG. 21 is a flow chart describing the display of a feature utilizing a variable wild reel according to an embodiment of the present invention.

Turning to FIG. 21, the method used to display the variable reel features, i.e., the unified variable reel, the first variable reel and the second variable reel, is described, according to one embodiment of the present invention. In a twenty-second step S22, the variable reel appears in the display area from outside of the display area. The wild or variable reel traverses the cells 64 in the grid and delivers the extra or replacement wild symbols to the predetermined positions in a twenty-third step S23, and the modified outcome is displayed in a twenty-fourth step S24.

Next is a description of a program of the gaming machine 10 for operating one or a plurality of computers as the control unit 50. The gaming machine 10 stores the program in the memory, and can execute the program. The gaming machine 10 can access the program stored in the memory and can operate as the gaming machine 10 of the present embodiment by the program.

Further, the program according to the embodiment, may be provided through a network or stored in a recording medium. Recording media such as a floppy (registered trademark) disk, CD-ROM, DVD, or ROM and the like, or semiconductor memory and the like are exemplified as a recording medium. In this case, a program stored in the memory uses a reading device inside the gaming machine 10 such as a floppy (registered trademark) disk drive device, CD-ROM drive device, and DVD drive device and the like.

The embodiment of the present invention is described above, but the present invention is not limited to such an embodiment, a variety of variations are possible.

In such an embodiment, a gaming machine providing a game in the form of a slot machine is described, but this is not limited thereto, and a game in the state of poker, a video card game called black jack, bingo, keno, a wheel game and the like may be provided. Further, it is possible to apply the present invention to a pachinko machine or a pachinko slot machine.

Referring to FIG. 1, in one embodiment, the control panel 26 includes a plurality of user input devices that may include an acceptor device which accepts media associated with a monetary value to establish a credit balance, a validator configured to identify the physical media, and a cash-out button actuatable to cause an initiation of a payout associated with the credit balance. The acceptor device may include a touchscreen display associated with the display unit 28 and/or the player tracking unit 57, the bill/ticket identification unit 32, the operation unit 36, the player tracking unit 57, a coin slot, a ticket in ticket out (TITO) system, a bill acceptor, and/or any suitable device that enables the gaming machine 10 to receive media associated with a monetary value and establish a credit balance for use in playing the gaming machine. In one embodiment, the acceptor device may be configured to receive physical media such as, for example, a coin, a medal, a ticket, a card, a bill, currency, and/or any suitable physical media that enables the gaming machine 10 to function as described herein. The acceptor device may also be configured to accept virtual media such as, for example, a player tracking account, a virtual credit balance, reward points, gaming credits, bonus points, and/or any suitable virtual media that enables the gaming machine 10 to function as described herein. For example, in one embodiment, the coin slot may include an opening that is configured to receive coins and/or tokens deposited by the player into the gaming machine 10. The control unit 50 converts a value of the coins and/or tokens to a corresponding amount of gaming credits that are used by the player to wager on games played on the gaming machine 10. The bill acceptor may include an input and output device that is configured to accept a bill, a ticket, and/or a cash card into the bill acceptor to enable an amount of gaming credits associated with a monetary value of the bills, ticket, and/or cash card to be credited to the gaming machine 10. In one embodiment, the bill acceptor also includes a printer (not shown) that is configured to dispense a printed voucher ticket that includes information indicative of an amount of credits and/or money paid out to the player by the gaming machine 10 during a gaming session. The voucher ticket may be used at other gaming devices, or redeemed for cash, and/or other items as part of a casino cashless system.

In the embodiment, determining the stop position of each reel is described as consecutively acquiring a random number that is used respectively, but the acquisition procedure of the random number is not limited to this. For example, when the game starts, the control unit 50 acquires these random numbers in a batch, and each random number may be stored in the storage area of the non-erasing memory 53, or the storage 54 when power failure occurs. In this type of situation, even when a power failure and the like occurs during a game, because the control unit 50 acquired the random number from the memory 53 or the storage 54 when the game started before the power failure occurred, when resuming the game after recovering from a power failure, the progress of the game can be reproduced. For example, when a game result obtaining a high payout is formed right before a power failure occurs, the player will be greatly dissatisfied if the progress of the game is not similar after recovering from a power failure. However, as mentioned above, when the game starts, all of the random numbers are acquired in a batch, and by saving these random numbers in the memory 53 or the storage 54, such great dissatisfaction can be avoided for the player because the progress of a game similar to before a power failure occurred can be reproduced after recovering from a power failure.

Further, in the embodiment, a bill or ticket is displayed as game value, and received by these bill/ticket identification devices, and a form where a ticket is output by a printer unit is described, but the present invention is not limited to this. The game value is a concept including tangible objects such as a coin, bill, coin, medal, ticket, and the like, or electronic data that has a value equivalent to these. For example, a coin is received by the coin acceptor, and there may be a form where a coin is paid by a coin hopper. A player is identified and credit that is accumulated in an account on a server is used, there may be a form where credit is paid to an account, information of credit stored in a storage medium of a magnetic card, IC card and the like are read and used, and there may be a form where credit is paid by writing to the storage medium.

Further, in the embodiment, when showing a free game provided as a bonus game, a bonus game that uses a different virtual reel strip from a primary game may be provided. Further, there could be provided a feature game according to a value of the random number acquired during a primary game.

Further, set conditions providing a bonus game are not limited to trigger determination or line determination, for example, there may be a configuration providing a bonus game when the bet number surpasses a predetermined value. There could be a configuration providing a bonus game according to a value of the random number acquired during a primary game.

Further, in the embodiment, a form providing a free game for a predetermined number of times as a bonus game is shown, and a bonus game that is not limited to a number of times may be provided. In this situation, there could be a configuration providing a bonus game until an end condition is satisfied, as an end condition is a combination of specified symbols, or a determining bonus game based on a random number.

Exemplary embodiments of a gaming device, a gaming system, and a method of providing an award to a player are described above in detail. The gaming device, system, and method are not limited to the specific embodiments described herein, but rather, components of the gaming device and/or system and/or steps of the method may be utilized independently and separately from other components and/or steps described herein. For example, the gaming device may also be used in combination with other gaming systems and methods, and is not limited to practice with only the gaming device as described herein. Rather, an exemplary embodiment can be implemented and utilized in connection with many other gaming system applications. For instance, the present invention is applicable to a gaming system which is a combination of a community gaming system and individual gaming devices.

A controller, computing device, or computer, such as described herein, includes at least one or more processors or processing units and a system memory. The controller typically also includes at least some form of computer-readable media. By way of example and not limitation, computer-readable media may include computer storage media and communication media. Computer storage media may include volatile and nonvolatile, removable and non-removable media implemented in any method or technology that enables storage of information, such as computer-readable instructions, data structures, program modules, or other data. Communication media typically embody computer-readable instructions, data structures, program modules, or other data in a modulated data signal, such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer-readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced other than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A gaming machine, comprising:

an acceptor device that accepts a physical item associated with a monetary value;

an operation unit configured to receive an operation of a player representative of a wager amount from a player;

a display unit operably coupled to the operation unit and configured to display a symbol display area, the symbol display area including a plurality of cells arranged in a grid; and, a control unit operably coupled to the operation unit and the display unit and being configured to initiate a game in response to player operation and to establish an outcome of the game, the control unit, in response to initiation of the game, being further configured to:

randomly establish a first set of symbols associated with the symbol display area, each symbol in the first set of symbols being associated with one of the plurality of cells in the group;

randomly establish a set of replacement symbols, each replacement symbol in the set of replacement symbols being associated with one of the plurality of cells in the group and adapted to replace the symbol from the first set of symbols associated with the respective cell in the grid;

divide the set of replacement symbols into a first group of replacement symbols and a second group of replacement symbols;

display the replacement symbols in the first group of replacement symbols and the replacement symbols in the second group of replacement symbols in the respective associated cells of the grid, the first group of replacement symbols, the second group of replacement symbols and any remaining symbols in the first set of symbols forming the outcome, wherein the control unit, in displaying the replacement symbols, is further configured to: display the replacement symbols in the first group of replacement symbols using a first feature and to display the replacement symbols in the second group of replacement symbols in the respective associated cells of the grid using a second feature; and, award a payout to the player as a function of the outcome, wherein the control unit is further configured to establish a credit balance associated with the monetary value, decrease the credit balance by the wager amount, and enable the player to cash out the credit balance in response to a cash out operation.

2. A gaming machine, as set forth in claim 1, wherein the control unit, in dividing the set of replacement symbols, is configured to:

divide the set of replacement symbols into an interim first group of replacement symbols and an interim second group of replacement symbols, establish a first estimated payout to the player as a function of the first set of symbols and the interim first group of replacement symbols, establish a second estimated payout to the player as a function of the first set of symbols, the interim first and second groups of replacement symbols, compare the second estimated payout to the first estimated payout, and, if the comparison does not meet a predetermined condition, display the replacement symbols in the first group of replacement symbols and the symbols in the second group of replacement symbols in the respective associated cells of the grid using a unified feature.

3. A gaming machine, as set forth in claim 2, wherein the control unit is further configured to display the replacement symbols using the first and second features, respectively, if the comparison of the first and second estimated payouts meets the predetermined condition.

4. A gaming machine, as set forth in claim 3, wherein the control unit is configured to establish successive interim first and second groups of replacement symbols until the predetermined condition is met, or a predetermined number of interim first and second groups of replacement symbols have been established.

5. A gaming machine, as set forth in claim 1, wherein the control unit is configured to detect a triggering condition, wherein the set of replacement symbols are established in response to detection of the triggering condition.

6. A gaming machine, as set forth in claim 1, wherein the control unit is configured to display the first set of symbols in the cells of the grid prior to display of the first and second features or the unified feature.

7. A gaming machine, as set forth in claim 1, wherein the game is a video slot game and the cells in the grid are arranged into a plurality of rows and a plurality of columns, wherein each column defines a reel of the video slot game, wherein the control unit is configured to display the first set of symbols in the cells of the grid in a manner to simulate rotating reels, the first set of symbols being displayed in the cells when the simulated rotating reels are stopped.

8. A gaming machine, as set forth in claim 7, wherein the first feature is displayed while the rotating reels are spinning.

9. A gaming machine, as set forth in claim 8, wherein the second feature is displayed after the rotating reels are stopped.

10. A gaming machine, as set forth in claim 7, wherein the first and second features are displayed while the rotating reels are spinning.

11. A gaming machine, as set forth in claim 7, wherein the first and second features are displayed after the rotating reels are stopped.

12. A gaming machine, as set forth in claim 1, wherein the first, second and unified features include a variable reel strip, the control unit being configured to move the variable reel strip over the grid to deposit the replacement symbols in the respective cells of the grid.

13. A gaming machine, as set forth in claim 12, wherein the variable reel strip is moved across the grid in a defined pattern, wherein the pattern is selected from a set of predefined patterns or dynamically determined.

14. A gaming machine, as set forth in claim 1, wherein the control unit in randomly establishing the set of replacement symbols, randomly established the cells in which the replacement symbols are to be inserted.

15. A gaming machine, as set forth in claim 14, wherein the replacement symbols are a wild symbol.

16. A gaming machine, as set forth in claim 14, wherein the replacement symbols are randomly selected from a set of possible replacement symbols.

17. A gaming machine, as set forth in claim 1, wherein each cell of the grid has an associated probability, wherein the control unit establishes the set of replacement symbols by randomly determining if a replacement symbol will appear in each cell as a function of the associated probability.

18. A gaming machine, as set forth in claim 17, wherein the probability associated with one of the cells of the grid is different than the probability associated with another one of the cells.

19. A gaming machine, as set forth in claim 1, wherein the grid includes a plurality of virtual reels, each virtual reel being populated by replacement and null symbols, wherein the control unit establishes the set of replacement symbols by randomly determining a stop position for each virtual reel.

20. A gaming machine, as set forth in claim 19, wherein the virtual reels are horizontal.

21. A gaming machine, as set forth in claim 20, wherein the virtual reels are vertical.

22. A control method for providing a game to a player using a gaming machine, the gaming machine including a control unit, an operation unit, and a display unit, the operation unit configured to receive operation from the player representative of a wager amount, the display unit operably coupled to the operation unit and being configured to display a symbol display area, the symbol display area including a plurality of cells arranged in a grid, the symbol display area including a plurality of cells arranged in a grid, the control unit, the control unit operably coupled to the operation unit and the display unit and being configured to initiate a game in response to player operation and to establish an outcome of the game, the control method, in response to initiation of the game performing the steps of:

accepting, at an acceptor device, a physical item associated with a monetary value;

establishing, by the control unit, a credit balance associated with the monetary value, decreasing the credit balance by the wager amount, and enabling the player to cash out the credit balance in response to a cash out operation;

randomly establishing, by the control unit, a first set of symbols associated with the symbol display area, each symbol in the first set of symbols being associated with one of the plurality of cells in the group;

randomly establishing, by the control unit, a set of replacement symbols, each replacement symbol in the set of replacement symbols being associated with one of the plurality of cells in the group and adapted to replace the symbol from the first set of symbols associated with the respective cell in the grid;

dividing, by the control unit, the set of replacement symbols into a first group of replacement symbols and a second group of replacement symbols;

displaying, in the display area of the display unit, the replacement symbols in the first group of replacement symbols and the replacement symbols in the second group of replacement symbols in the respective associated cells of the grid, the first group of replacement symbols, the second group of replacement symbols and any remaining symbols in the first set of symbols forming the outcome, wherein the control unit, in displaying the replacement symbols, displays the replacement symbols in the first group of replacement symbols using a first feature and displays the replacement symbols in the second group of replacement symbols in the respective associated cells of the grid using a second feature; and awarding, by the control unit, a payout to the player as a function of the outcome.

23. A method, as set forth in claim 22, wherein the step of dividing the set of replacement symbols, includes the steps of:

dividing the set of replacement symbols into an interim first group of replacement symbols and an interim second group of replacement symbols, establishing a first estimated payout to the player as a function of the first set of symbols and the interim first group of replacement symbols, establishing a second estimated payout to the player as a function of the first set of symbols, the interim first and second groups of replacement symbols, comparing the second estimated payout to the first estimated payout, and if the comparison does not meet a predetermined condition, displaying the replacement symbols in the first group of replacement symbols and the symbols in the second group of replacement symbols in the respective associated cells of the grid using a unified feature.

24. A method, as set forth in claim 23, including the step of displaying the replacement symbols using the first and second features, respectively, if the comparison of the first and second estimated payouts meets the predetermined condition.

25. A method, as set forth in claim 24, including the step of establishing successive interim first and second groups of replacement symbols until the predetermined condition is met, or a predetermined number of interim first and second groups of replacement symbols have been established.

26. A method, as set forth in claim 22, including the step of detecting a triggering condition, wherein the set of replacement symbols are established in response to detection of the triggering condition.

27. A method, as set forth in claim 22, wherein the first set of symbols are displayed in the cells of the grid prior to display of the first and second features or the unified feature.

28. A method, as set forth in claim 22, wherein the game is a video slot game and the cells in the grid are arranged into a plurality of rows and a plurality of columns, wherein each column defines a reel of the video slot game, wherein the first set of symbols are displayed in the cells of the grid in a manner to simulate rotating reels, the first set of symbols being displayed in the cells when the simulated rotating reels are stopped.

29. A method, as set forth in claim 28, wherein the first feature is displayed while the rotating reels are spinning.

30. A method, as set forth in claim 29, wherein the second feature is displayed after the rotating reels are stopped.

31. A method, as set forth in claim 28, wherein the first and second features are displayed while the rotating reels are spinning.

32. A method, as set forth in claim 28, wherein the first and second features are displayed after the rotating reels are stopped.

33. A method, as set forth in claim 22, wherein the first, second and unified features include a variable reel strip, the method including the step of moving the variable reel strip over the grid to deposit the replacement symbols in the respective cells of the grid.

34. A method, as set forth in claim 33, wherein the variable reel strip is moved across the grid in a defined pattern, wherein the pattern is selected from a set of predefined patterns or dynamically determined.

35. A method, as set forth in claim 22, wherein the step of randomly establishing the set of replacement symbols includes the step of randomly establishing the cells in which the replacement symbols are to be inserted.

36. A method, as set forth in claim 35, wherein the replacement symbols are a wild symbol.

37. A method, as set forth in claim 35, wherein the replacement symbols are randomly selected from a set of possible replacement symbols.

38. A method, as set forth in claim 22, wherein each cell of the grid has an associated probability, wherein the step of establishing the set of replacement symbols includes the step of randomly determining if a replacement symbol will appear in each cell as a function of the associated probability.

39. A method, as set forth in claim 38, wherein the probability associated with one of the cells of the grid is different than the probability associated with another one of the cells.

40. A method, as set forth in claim 22, wherein the grid includes a plurality of virtual reels, each virtual reel being populated by replacement and null symbols, wherein the set of replacement symbols is established by randomly determining a stop position for each virtual reel.

41. A method, as set forth in claim 40, wherein the virtual reels are horizontal.

42. A method, as set forth in claim 40, wherein the virtual reels are vertical.

43. A program, stored on a non-transitory information recording medium, for a gaming machine for providing a game to a player, wherein the gaming machine including a control unit, an operation unit, and a display unit, the operation unit configured to receive operation from the player, the display unit operably coupled to the operation unit and being configured to display a symbol display area, the symbol display area including a plurality of cells arranged in a grid, the symbol display area including a plurality of cells arranged in a grid, the control unit, the control unit operably coupled to the operation unit and the display unit and being configured to initiate a game in response to player operation representative of a wager amount and to establish an outcome of the game, the program of the gaming machine performing the steps of:

accepting, at an acceptor device, a physical item associated with a monetary value;

establishing, by the control unit, a credit balance associated with the monetary value, decreasing the credit balance by the wager amount, and enabling the player to cash out the credit balance in response to a cash out operation, randomly establishing, by the control unit, a first set of symbols associated with the symbol display area, each symbol in the first set of symbols being associated with one of the plurality of cells in the group;

randomly establishing, by the control unit, a set of replacement symbols, each replacement symbol in the set of replacement symbols being associated with one of the plurality of cells in the group and adapted to replace the symbol from the first set of symbols associated with the respective cell in the grid;

dividing, by the control unit, the set of replacement symbols into a first group of replacement symbols and a second group of replacement symbols;

displaying, in the display area of the display unit, the replacement symbols in the first group of replacement symbols and the replacement symbols in the second group of replacement symbols in the respective associated cells of the grid, the first group of replacement symbols, the second group of replacement symbols and any remaining symbols in the first set of symbols forming the outcome, wherein the control unit, in displaying the replacement symbols, displays the replacement symbols in the first group of replacement symbols using a first feature and displays the replacement symbols in the second group of replacement symbols in the respective associated cells of the grid using a second feature; and, awarding, by the control unit, a payout to the player as a function of the outcome.

* * * * *